US010101058B2

(12) United States Patent
Kim et al.

(10) Patent No.: US 10,101,058 B2
(45) Date of Patent: Oct. 16, 2018

(54) AIR CONDITIONING EQUIPMENT

(71) Applicant: SAMSUNG ELECTRONICS CO., LTD., Suwon-si, Gyeonggi-do (KR)

(72) Inventors: Ki-jun Kim, Suwon-si (KR); Won-hee Lee, Yongin-si (KR); Sang-ki Cho, Seoul (KR); Kwon-jin Kim, Suwon-si (KR); Yun-suk Park, Suwon-si (KR); Kang-ho Choi, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 66 days.

(21) Appl. No.: 14/946,969

(22) Filed: Nov. 20, 2015

(65) Prior Publication Data

US 2016/0146502 A1 May 26, 2016

(30) Foreign Application Priority Data

Nov. 26, 2014 (KR) ..... 10-2014-0166640

(51) Int. Cl.
*F24H 8/00* (2006.01)
*F24F 3/14* (2006.01)
*F24F 6/00* (2006.01)

(52) U.S. Cl.
CPC ..... *F24H 8/006* (2013.01); *F24F 3/1405* (2013.01); *F24F 2003/1446* (2013.01); *F24F 2006/008* (2013.01)

(58) Field of Classification Search
CPC ..... F24H 8/006; F24H 8/00; F24H 3/1405; F24F 2006/008; F24F 2003/1446;
(Continued)

(56) References Cited

U.S. PATENT DOCUMENTS 2,966,388 A * 12/1960 Kimball ..... A47B 88/487 312/333
3,411,569 A * 11/1968 Hildreth ..... F24F 1/02 165/63

(Continued)

FOREIGN PATENT DOCUMENTS

CN 101191657 A * 6/2008
ES 2 267 385 3/2007

(Continued)

OTHER PUBLICATIONS

Translation of Shimizu (JP 1183073 A).*

(Continued)

*Primary Examiner* — Tho V Duong
(74) *Attorney, Agent, or Firm* — Staas & Halsey LLP

(57) ABSTRACT

An air conditioning equipment includes a housing comprising a heat exchanger therein, a water container mounted to, and dismounted from a receiving portion of the housing and to collect a condensate generated by the heat exchanger, and a valve configured to selectively open and close a discharge port by being interfered with a portion of the water container according to the mounting and the dismounting of the water container to or from the receiving portion of the housing. The valve is inserted within the receiving portion of the housing through the discharge port in order to reduce a protruded length that is interfered by the portion of the water container.

24 Claims, 32 Drawing Sheets

(58) Field of Classification Search
CPC ..... F24F 3/1405; F24F 3/14; F24F 13/222; F24F 1/02; F25D 21/14; A47B 88/40; A47B 88/453; A47B 88/46; A47B 88/60
See application file for complete search history.

(56) References Cited

U.S. PATENT DOCUMENTS

| | | | | |
|---|---|---|---|---|
| 5,226,453 | A * | 7/1993 | Biggers | F16K 1/14 137/801 |
| 5,683,015 | A | 11/1997 | Lee | |
| 5,792,390 | A | 8/1998 | Marino | |
| 5,797,426 | A * | 8/1998 | Powell | F16K 15/04 137/433 |
| 8,356,616 | B2 | 1/2013 | Wyatt | |
| 2008/0258592 | A1* | 10/2008 | Blum | A47B 88/437 312/334.1 |
| 2010/0236278 | A1* | 9/2010 | Eom | F25D 23/021 62/449 |
| 2012/0195055 | A1* | 8/2012 | Prichard | F21V 21/26 362/401 |

FOREIGN PATENT DOCUMENTS

| | | | | |
|---|---|---|---|---|
| JP | 4-332324 | | 11/1992 | |
| JP | 08312993 | A * | 11/1996 | F24F 3/153 |
| JP | 11-83073 | | 3/1999 | |
| JP | 2000-266360 | | 9/2000 | |
| KR | 20020088808 | A * | 11/2002 | |
| KR | 10-1341375 | | 12/2013 | |
| WO | WO 2013/129764 | | 9/2013 | |

OTHER PUBLICATIONS

International Search Report dated Jan. 18, 2016 in International Patent Application No. PCT/KR2015/010878.
Written Opinion of the International Searching Authority dated Jan. 18, 2016 in International Patent Application No. PCT/KR2015/010878.
European Search Report dated Oct. 4, 2017 in corresponding European Patent Application No. 15 86 2900.
Australian Office Action dated Mar. 15, 2018 in Australian Patent Application No. 2015354430.
Russian Office Action dated May 18, 2018 in Russian Patent Application No. 2017122145.

* cited by examiner

AIR CONDITIONING EQUIPMENT

CROSS-REFERENCE TO RELATED APPLICATIONS

This application claims priority from Korean Patent Application No. 10-2014-0166640, filed on Nov. 26, 2014 in the Korean Intellectual Property Office, the disclosure of which is incorporated herein by reference in its entirety.

BACKGROUND

1. Field

Equipments consistent with what is disclosed herein relate to an air purifying equipment, and more specifically, to an air conditioning equipment configured to prevent condensate generated internally from flowing externally.

2. Description of the Related Art

An air conditioning equipment operates to perform humidifying, dehumidifying, cooling, and heating functions by using refrigerant cycle, and is used in various areas of our daily lives.

Among the above-mentioned functions, the dehumidifying function reduces the water content in the air by absorbing the heat from the vapor of the air, thus phase-changing the vapor in gas phase into the water in liquid phase with a heat exchanger. Accordingly, a user is provided with more comfortable indoor environment.

Specifically, the use of the dehumidifier further increases in the humid summer. When use of the dehumidifier increases, a problem can occur as it is necessary for a user to more frequently empty the water in the water container considering insufficient capacity of the water collecting container for storing the condensate.

Further, when removing the water collecting container from the air conditioning equipment in order to drain the stored water from the water collecting container, the condensate remaining within the air conditioning equipment may be discharged externally. Thus, a user may have the inconvenience of having to wipe the condensate.

Additionally, because a user has to sit at the height of the air conditioning equipment and release the hook coupling by exerting external force to the water collecting container with his or her hands in order to separate the water collecting container from the air conditioning equipment, a user is inconvenienced when using the air conditioning equipment.

SUMMARY

Exemplary embodiments of the present inventive concept overcome the above disadvantages and other disadvantages not described above. Also, the present inventive concept is not required to overcome the disadvantages described above, and an exemplary embodiment of the present inventive concept may not overcome any of the problems described above.

According to an embodiment, a technical objective is to provide an air conditioning equipment such as a dehumidifier having therein an opening and closing portion to open and close a discharge port for a condensate generated within the air conditioning equipment to flow to a water container, to secure water storage of the water container.

Another technical objective is to provide an air conditioning equipment such as a dehumidifier with enhanced durability and reliability, which blocks an opening and closing portion to open and close a discharge port provided within the air conditioning equipment from the condensate.

Yet another technical objective is to provide an air conditioning equipment such as a dehumidifier which is easy to use, as it is enabled to remove a water container from the air conditioning equipment with only one operation.

According to an embodiment, an air conditioning equipment may include a housing comprising a heat exchanger therein, a water container mounted to, and dismounted from a receiving portion of the housing and to collect a condensate generated by the heat exchanger; and a valve configured to selectively open and close a discharge port by being interfered with a portion of the water container according to the mounting and the dismounting of the water container to or from the receiving portion of the housing. The valve may be inserted within the receiving portion of the housing through the discharge port in order to reduce a protruded length that is interfered by the portion of the water container.

The valve may include a sealing member arranged along an edge of the discharge port, a lid member selectively seated on the sealing member, and a cover covering the lid member. The cover may be provided with an opening formed on a portion at which the cover meets a discharge path guiding the condensate to the discharge port.

The valve may additionally include a first elastic member arranged between the lid member and the cover, pressing the lid member toward a gravity direction.

The lid member may be formed in a spherical shape.

The sealing member may be provided with a seating portion corresponding to the shape of an exterior surface of the lid member in order to surface-contact the lid member.

The sealing member may be formed of a rubber material.

The cover may be engaged to the housing according to at least one of hook engaging and screw engaging.

The cover may include a guide rib therein to guide a perpendicular movement of the lid member within the internal area.

The water container may include an inlet to which the condensate discharged from the discharge port is introduced, and a guide configured to interfere with the valve during the mounting to the housing.

The water container may additionally include an absorbing member to absorb the condensate remaining on a lower portion of the valve, to a portion of the upper surface on which the guide is formed.

The absorbing member may be set in a position in which the absorbing member is aligned with the valve along the direction in which the water container is disengaged.

The housing may include an auxiliary discharge port configured to discharge the condensate exceeding a preset level when the water container is disengaged, and a water storage recess on a bottom surface of the housing corresponding to the auxiliary discharge port.

The air conditioning equipment may include a casing to which the water container is mounted, a guide panel formed on the casing to guide along a path in which the casing is mounted to, and dismounted from the housing, a sliding portion formed on the housing and slidably contacting the guide panel, and an external force transmitter configured to exert an external force to the sliding portion so that the sliding portion starts sliding with respect to the guide panel.

The guide panel may include a guide surface sliding with respect to the sliding portion, and a locking portion configured to limit the sliding of the casing with the sliding portion when mounted to the housing.

The guide surface may include a deceleration section which reduces a sliding speed of the sliding portion.

The guide panel may be formed on the casing, upwardly slanted.

The sliding portion may include a first and a second sliders for sliding on the guide panel, and a second elastic member arranged between the first and the second sliders to exert a force in a direction in which the first and the second sliders are spaced from each other.

The external force transmitter may include a button arranged on an upper surface of the housing, and a shaft which transmits the external force exerted on the button to the sliding portion.

In an embodiment, an air conditioning equipment may include a housing comprising a heat exchanger therein, a water container which collects a condensate generated by the heat exchanger, and a valve inserted within a receiving portion of the housing, and comprising a lid member to selectively open and close a discharge port by being interfered by the water container when the water container is mounted to, and dismounted from the receiving portion of the housing. The lid member may be curved and protruded, while being positioned over the discharge port.

The lid member may be formed in a spherical shape or a semi-spherical shape.

In another embodiment, a dehumidifier may include a housing forming an exterior of the dehumidifier and including a discharge port to discharge condensate from the housing, a water storage container engaged with the housing to collect the condensate discharged from the housing, the water storage container including a guide formed on an upper surface of the water storage container, and a valve arranged on a portion of the housing where the discharge port is formed, the valve comprising a lid member formed to correspond to a shape of the discharge port to selectively block the discharge port in accordance with a relative position of the guide with respect to the lid member.

In another embodiment, a dehumidifier may include a housing forming an exterior of the dehumidifier and including a discharge port to discharge condensate from the housing, a water storage container engaged with the housing to collect the condensate discharged from the housing, the water storage container including a protrusion formed on an upper surface of the water storage container, and a valve arranged on a portion of the housing where the discharge port is formed to selectively open and close the discharge port. The valve may include a hinged panel having a first end and a second end, a lid member disposed at the first end of the hinged panel and formed to correspond to a shape of the discharge port so as to selectively open and close the discharge port, and a weighted load member disposed at the second end of the panel to exert a force to rotate the panel in a direction in which the lid member closes the discharge port unless the protrusion contacts the hinged panel thereby lifting the weighted load member in a direction opposite of gravity and rotating the panel in a direction in which the lid member opens the discharge port.

BRIEF DESCRIPTION OF THE DRAWINGS

The above and/or other aspects of the present inventive concept will be more apparent by describing certain exemplary embodiments of the present inventive concept with reference to the accompanying drawings, in which.

DETAILED DESCRIPTION

Figure 1:
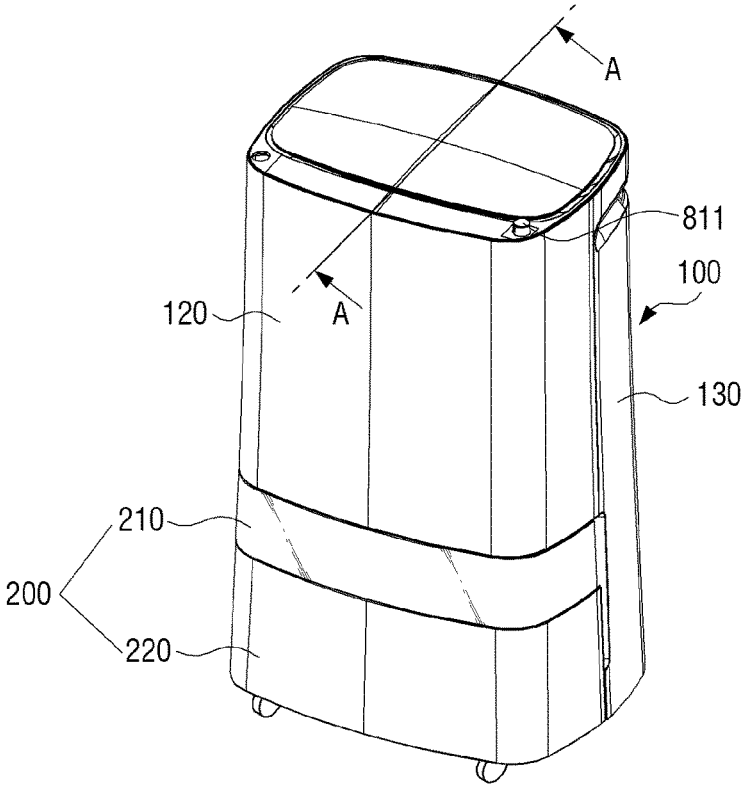
FIG. 1 (RELATED ART)
FIG. 1 is a perspective view of an air conditioning equipment according to a first embodiment.
Figure 2:
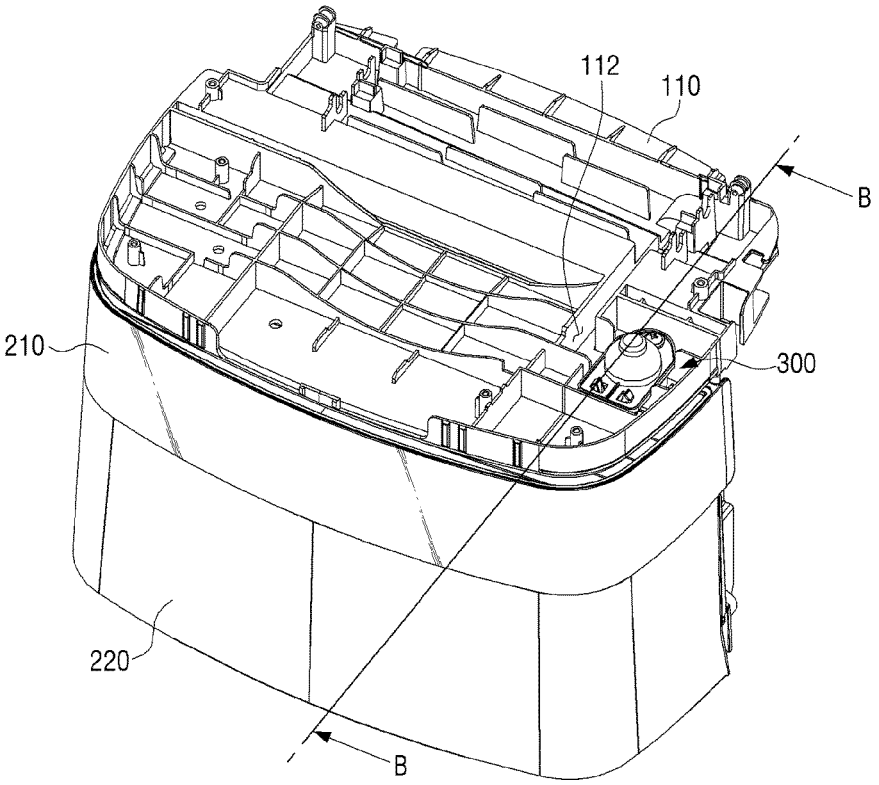
FIG. 2 is a perspective view of a water container illustrated in FIG. 1 and a lower casing mounted to the water container.
Figure 3:
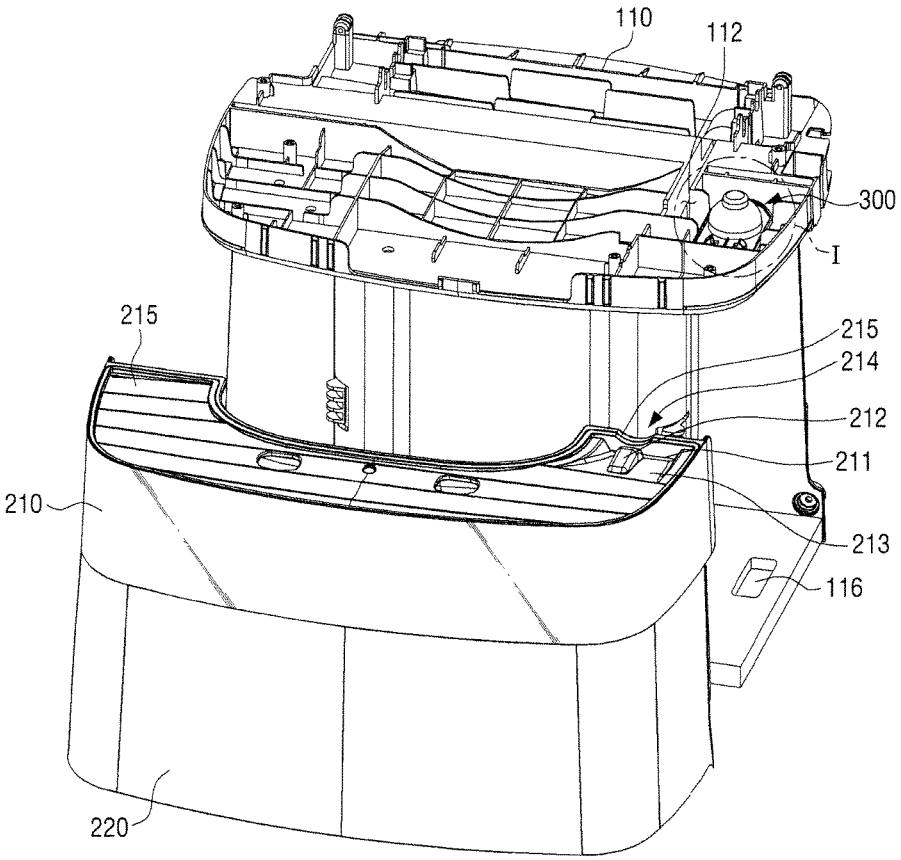
FIG. 3 is a perspective view illustrating the water container and the lower casing illustrated in FIG. 2 in disengaged state.

Certain exemplary embodiments of the present inventive concept will now be described in greater detail with reference to the accompanying drawings.

In the following description, same drawing reference numerals are used for the same elements even in different drawings. The matters defined in the description, such as detailed construction and elements, are provided to assist in a comprehensive understanding of the present inventive concept. Accordingly, it is apparent that the exemplary embodiments of the present inventive concept can be carried out without those specifically defined matters. Also, well-known functions or constructions are not described in detail since they would obscure the disclosure with unnecessary detail.

Referring to FIGS. 1 to 5, an air conditioning equipment 1 according to a first embodiment includes a housing 100, a water storage 200, and a valve 300.

The housing 100 includes therein a compressor, a heat exchanger, and electric portions. The housing 100 defines an exterior shape of the air conditioning equipment 1, and includes a lower casing 110, an upper casing 120 and a rear cover 130.

The lower casing 110 includes the electric portions to control the air conditioning equipment 1 arranged therein, and a discharge path 112 along which the condensate generated by the heat exchanger flows. Further, on a portion of the discharge path 112, a discharge port 111 is formed to discharge the condensate from the housing 100.

The upper casing 120 may be engaged with the upper portion of the lower casing 110, and may protect the compressor, the heat exchanger, and the electric portions from exposure to the outside.

The rear cover 130 is mounted to a rear portion of the air conditioning equipment 1, thus defining an appearance of the air conditioning equipment 1.

The water storage 200 may be engaged with the housing 100, and may include a water container 210 and a casing 220. The water storage 200 may be fixed to the housing by hook coupling with the housing 100. A user may disengage the water storage 200 by exerting an external force toward the dismounting direction of the water storage 200. However, in order to reduce associated inconvenience, alternative method to disengage the water storage 200 from the housing 100 may be applied, which will be described below.

The water container 210 may be engaged with the lower casing 110 while being mounted to the upper portion of the casing 220. The water container 210 may collect the condensate generated by the heat exchanger arranged within the air conditioning equipment 1. The water container 210 may include an inlet 211, a guide 212, a slanted portion 213, and an avoiding groove 214.

Further, in an embodiment, the water container 210 may be preferably formed of the transparent materials which allow a user to observe the amount of the stored water. Thus, when the height of the water stored in the water container 210 is higher than the height of the casing 220 while the water container 210 is mounted to the casing 220, a user may notice the amount of the stored water through the transparent portion of the water container 210, and the user may thus determine the time when the stored water in the water container 210 needs to be emptied.

The inlet 211 may be formed on a portion of the upper surface 215 corresponding to the discharge port 111, and depressed downward along the slanted portion 213 in an upper surface 215 of the water container 210. Further, there may be two inlets 211 according to an embodiment provided on both sides of the guide 212, but exemplary embodiments are not limited thereto. Accordingly, three or more inlets may alternatively be provided.

The guide 212 may be formed on a portion of the upper surface 215 of the water container 210 corresponding to a lid member 312 of the valve 300, and may selectively open and close the valve 300. This will be described below in more detail when explaining the driving operation of the air conditioning equipment 1 according to a first embodiment.

The avoiding groove 214 may be provided on an end in the mounting direction of the water storage 200 on the upper surface 215 where the guide 212 is formed. The avoiding groove 214 may prevent the lid member 312 from being interfered with by an edge of the water container 210 before the discharge port 111 is opened by the guide 212.

Further, the avoiding groove 214 may be arranged with an absorbing member 215 to clean the remaining condensate on the lower surface of the lid member 312 when the water storage 200 is disengaged. Polyurethane may be used for the material of the absorbing member, although exemplary embodiments are not limited thereto. Accordingly, any material that can absorb water may be applied.

Figure 4:
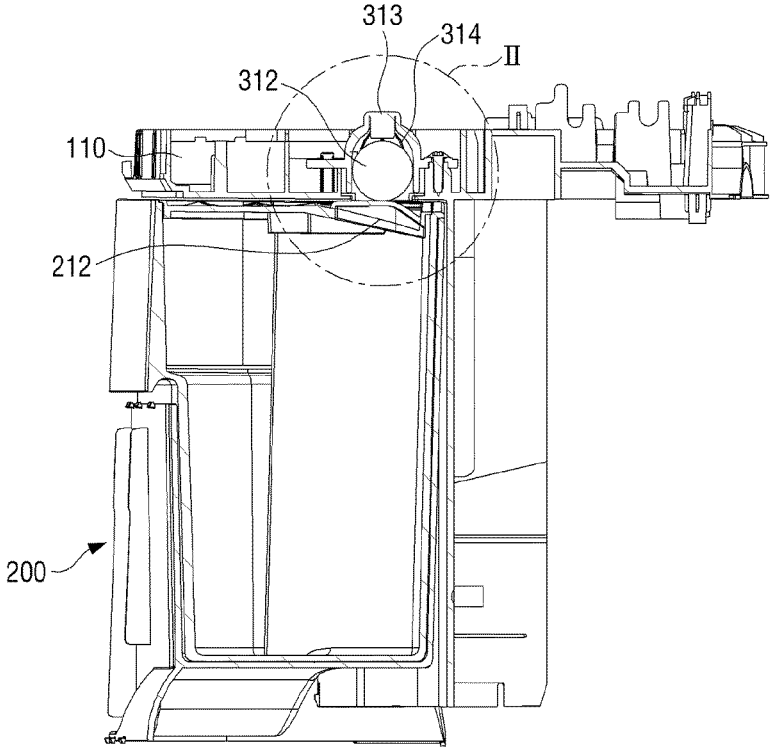
FIG. 4 is a cross sectional view taken on line B-B of FIG. 2.
Figure 5:
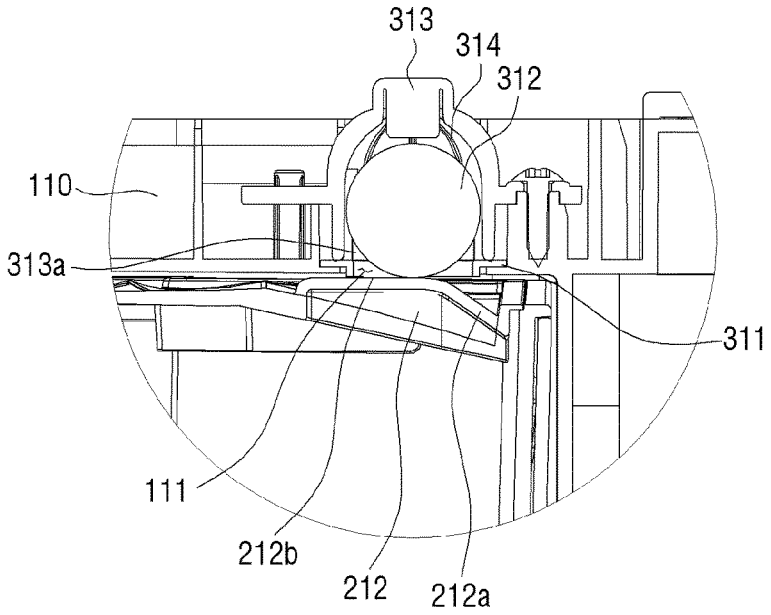
FIG. 5 is an enlarged view of an encircled area II of FIG. 4.
Figure 6:
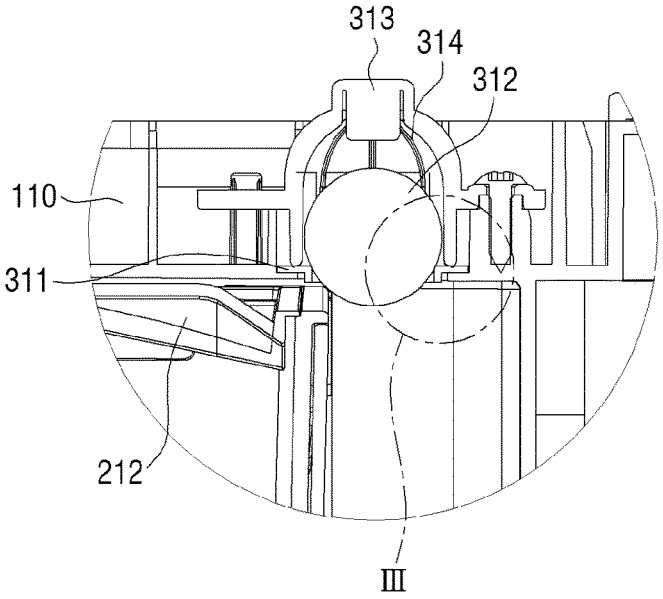
FIG. 6 is an enlarged view illustrating a state in which the water container is separated from the air conditioning equipment illustrated in FIG. 5.

Referring to FIGS. 4, 5, and 6, the valve 300 according to the first embodiment may be arranged on a portion where the discharge port 111 is formed within the housing 100 in order to selectively open and close the discharge port 111. The valve 300 may include a sealing member 311, the lid member 312 and the cover 313.

Figure 7:
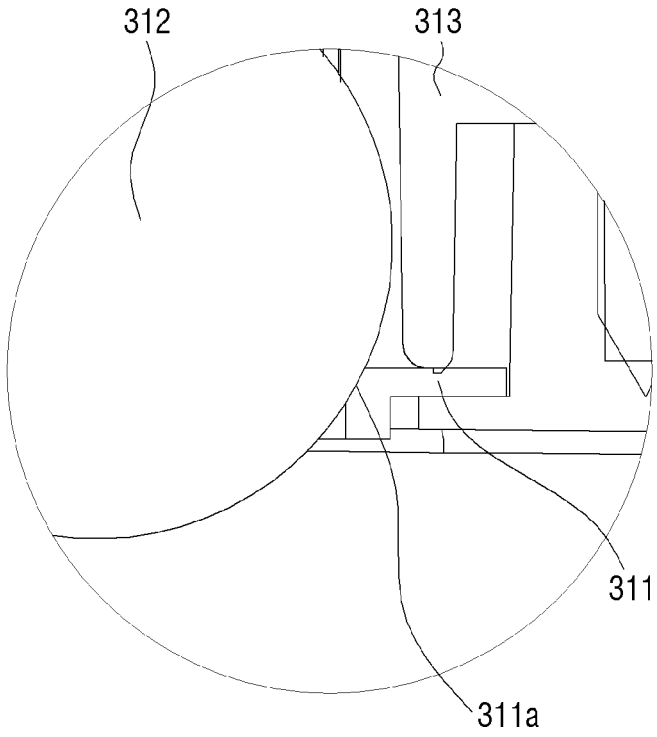
FIG. 7 is an enlarged view of an encircled area III of FIG. 6.

The sealing member 311 may be arranged along the edge or circumference of the discharge port 111 correspondingly to the shape of the discharge port 111. The discharge port 111 according to an embodiment may be in a circular shape. Thus, the sealing member 311 may be arranged in a circular fashion. Further, in order to maximize the sealing effect with the contact of the lid member 312 which will be described below, rubber may be preferably used for the sealing member 311. Further, as illustrated in FIG. 7, the sealing member 311 may be formed with a seating portion 311*a* so that the sealing is performed more efficiently by surface-contacting the lid member 312.

The lid member 312 may be formed correspondingly to the shape of the discharge port 111 so as to block the discharge port 111. The discharge port 111 according to an embodiment may have a circular shape. Accordingly, the lid member 312 may have a spherical shape correspondingly. Preferably, the lid member 312 may itself have a considerable weight in order to ensure that the lid member 312 blocks the discharge port 111 with its own weight when the water storage 200 is disengaged. Thus, a steel ball or sphere may be used for the lid member 312.

Figure 8:
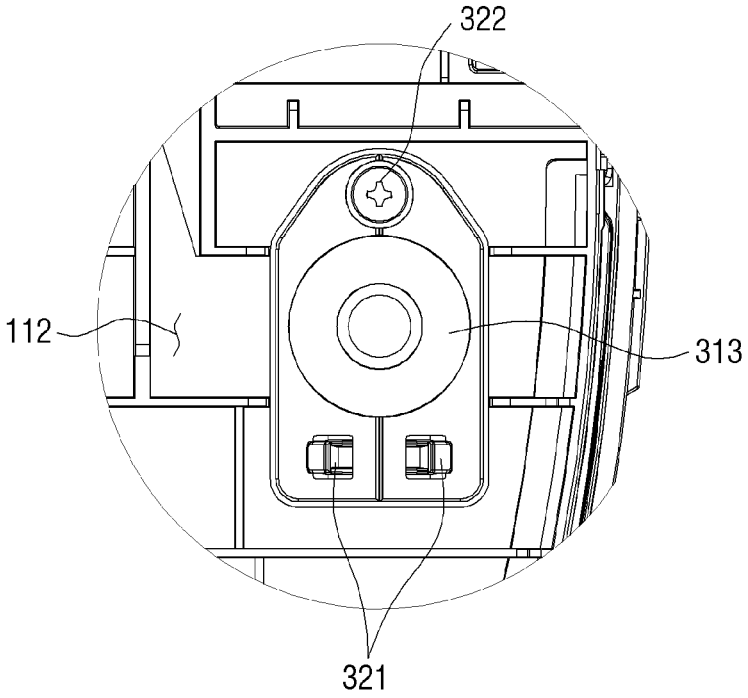
FIG. 8 is an enlarged, upper view of the encircled area I of FIG. 3.
Figure 9:
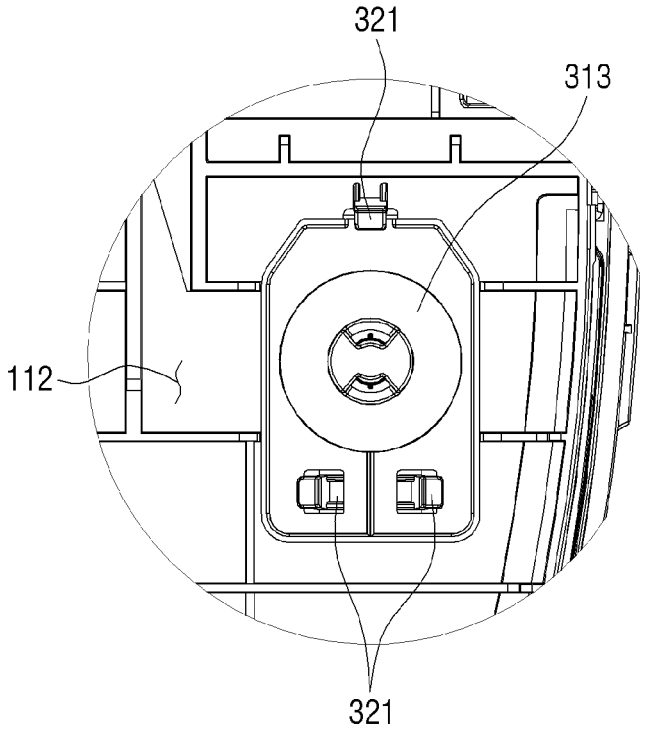
FIG. 9 is an enlarged view of a cover in FIG. 8 according to a modified exemplary embodiment.

The cover 313 may be seated and fixed on the upper surface of the sealing member 311 so that the lid member 312 is arranged internally. The cover 313 according to an embodiment may be fixed by using two hooks 321 and one screw 322, as illustrated in FIG. 8. However, the cover 313 may be fixed by using three hooks 321, as illustrated in FIG. 9. Using the hooks only can save unit cost and facilitate the installation compared to fixing with the screw coupling.

Further, a guide rib 314 may be formed within the cover 313, which prevents the lid member 312 from being separated from a vertical movement within the cover 313. An opening 313*a* may be formed on a portion corresponding to the discharge path 112 of the lower portion of the cover 313, thus, allowing the condensate to be discharged to an external area of the air conditioning equipment 1, e.g., to the water container 210, through the discharge port 111.

Figure 10:
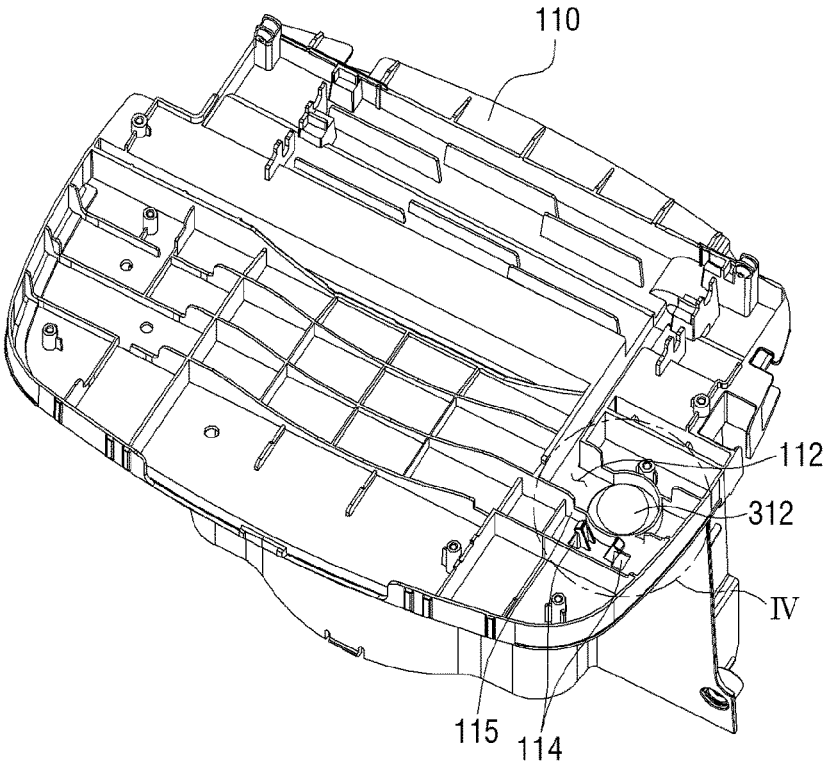
FIG. 10 is a perspective view of the lower casing of FIG. 2.
Figure 11:
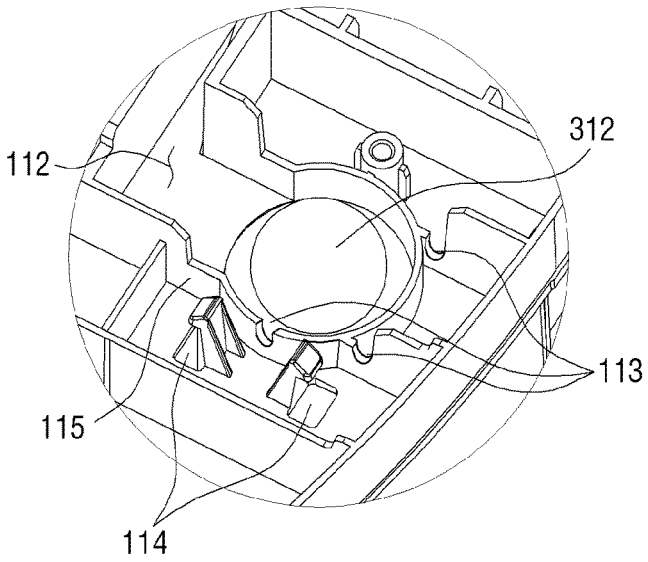
FIG. 11 is an enlarged view of an encircled area IV of FIG. 10.

Referring to FIGS. 10 and 11, the air conditioning equipment 1 according to a first embodiment may include a plurality of draining grooves 113 and an auxiliary discharge port 114.

When the water storage 200 is disengaged from the housing 100 and the discharge port 111 is closed, the remaining condensate generated by the heat exchanger may stay on the discharge path 112. Herein, a partition 115 is formed to surround the discharge port 111 to a preset height so as to block the remaining condensate from overflowing. Thus, the remaining condensate will not typically flow over the partition 115.

However, when a user moves the housing 100, the remaining condensate may flow over the partition 115, and the electric portions in the area other than the discharge port 111 may be damaged. Thus, the partition 115 may include a plurality of the draining grooves 113 having a lower height than the height of the partition 115, which induces the condensate to flow toward the auxiliary discharge port 114 when there is more than a certain level of the condensate remaining. Accordingly, the remaining condensate discharged through the auxiliary discharge port 114 may be stored in a water storage recess 116 illustrated in FIG. 3. Further, although an embodiment illustrates the two auxiliary discharge ports 113, one auxiliary discharge port, or three or more auxiliary discharge ports may be provided.

The following will explain the draining process of the air conditioning equipment 1 according to the first embodiment.

First, a user may engage the water storage 200 with the housing 100 and drive the air conditioning equipment 1, as illustrated in FIG. 1. In this case, the guide 212 formed on the water container 210 may lift the lid member 312 so that the discharge port 111 is opened.

The heat exchanger within the housing 100 absorbs the heat of the vapor contained in the air and phase-changes the vapor into water in liquid state. The condensate may flow toward the discharge port 111 along the discharge path 112.

The condensate flowing toward the discharge port 111 may be discharged to the upper surface of the water container 210 through the opening 313*a* formed on the cover 313 and then the opened discharge port 111 under the lid member 312.

The condensate discharged at the discharge port 111 gravitates down along the guide 212 and the slanted portion 213, and is stored within the water container 210 through the inlet 211.

While the air conditioning equipment 1 is driving, the amount of the condensate stored in the water container 210 may increase. When it comes to the full state in which further water storing is not allowed, a user may stop driving the air conditioning equipment 1, disengage the water storage 200 from the housing 100, and empty the condensate stored in the water container 210.

When the water storage 200 is disengaged from the housing 100, the interference of the guide 212 lifting the lid member 312 is released, and the lid member 312 may be seated to the sealing member 311 with its own weight. Herein, the lid member 312 surface-contacts the seating portion 311*a* of the sealing member 311, and thus can have maximized sealing effects.

Further, differently from the illustrations, if the positions where the discharge port 111 and the guide 212 are formed are moved in the direction in which the water storage 200 is disengaged, a small amount of the condensate may be prevented from flowing externally the moment when the water storage 200 is disengaged.

Thereafter, when the discharge port 111 is closed, the condensate remaining within the housing 100 may have a height less than the height of the partition 115, and may stay on the discharge path 112.

Herein, when a user moves the air conditioning equipment 1 in order to change the position, the condensate remaining within the housing 100 may be slopped and flow over the height of the partition 115. The condensate flowing over the height of the partition 115 may be guided to the auxiliary discharge port 113 by a plurality of the draining grooves 114, and discharged externally by the auxiliary discharge port 113. The condensate discharged at the auxiliary discharge port 113 may be stored on the water storage recess 116 formed in the lower side of the lower casing 110.

After emptying the condensate stored in the water container 210, the user may engage the water container 210 with the casing 220, and engage the water storage 200 with the housing 100 again. In this case, a first surface 212*a* of the guide 212 contacts the lid member 312 again, and lifts the lid member 312. Thereafter, a second surface 212*b* contacts the lid member 312 and supports the lid member 312 upward, thus opening the discharge port 111.

Because the valve 300 according to an embodiment is arranged within the housing 100, the space used by the water container 210 may be ensured and the amount of the stored water may increase compared to the case in which the valve is arranged outside the housing 100.

Figure 12:
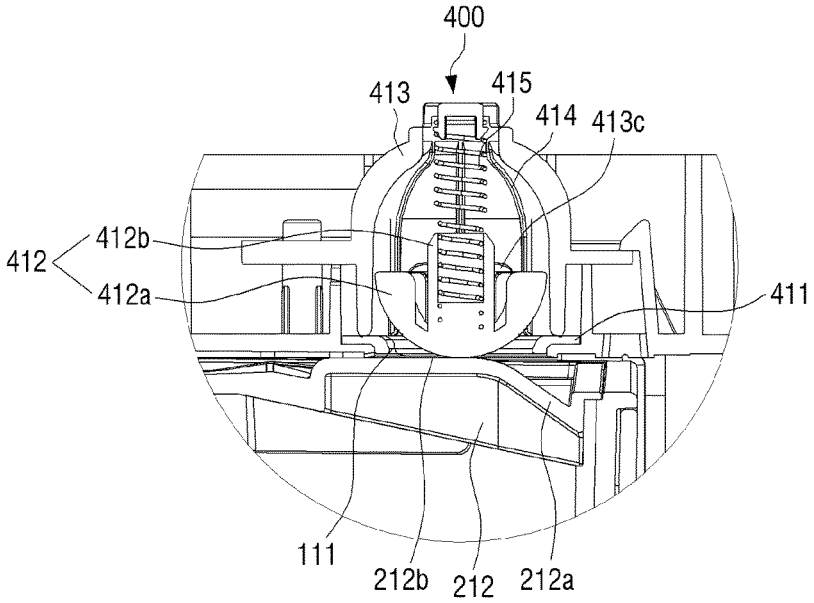
FIG. 12 is an enlarged view of an encircled area II of FIG. 4 according to a second embodiment.
Figure 13:
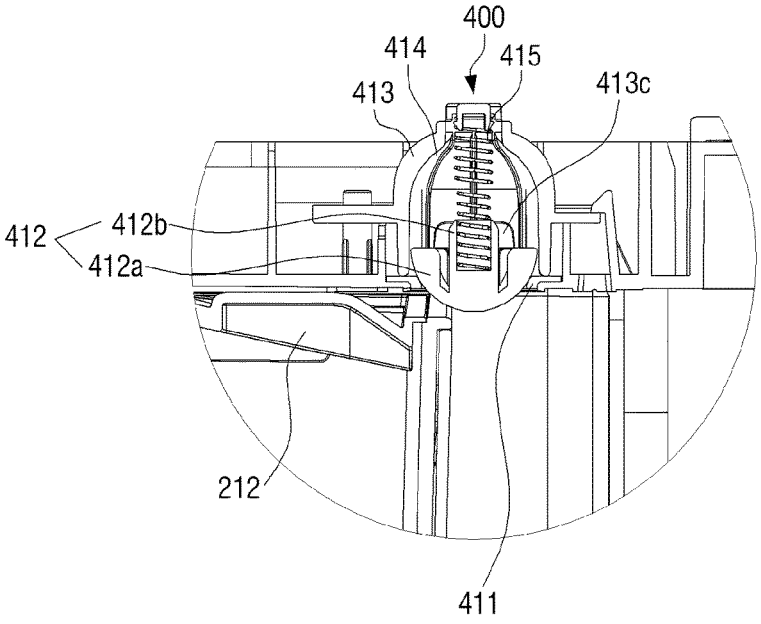
FIG. 13 is an enlarged view illustrating the state in which the water container is separated from the air conditioning equipment illustrated in FIG. 12.

Referring to FIGS. 12 and 13, the air conditioning equipment 1 according to a second embodiment will be explained below.

For the sake of brevity, redundant descriptions about the housing 100 and the water storage 200 will be omitted in view of the first embodiment already described above, while different constitutions will be mainly described.

The valve 400 according to a second embodiment includes a sealing member 411, a lid member 412, a cover 413, a guide rib 414 and a first elastic member 415.

According to the second embodiment, the lid member 412 may include a lower portion 412*a* protruding downward in a semi-spherical shape, and an upper portion 412*b* formed in a cylindrical shape extending upward from the center of the semi-sphere. Further, the first elastic member 415 may be provided within a center of the lid member 412. The first elastic member 415 may be fixed on the upper portion of the cover 413.

When the water storage 200 is disengaged from the housing 100, the first elastic member 415 may push the lid member 412 toward the gravity direction, thus causing the discharge port 111 to be closed. Meanwhile, when the water storage 200 is engaged with the housing 100, the first elastic member 415 may keep the compressed state by the guide 212. Thus, the lid member 412 according to the second embodiment may close the discharge port 111 using the elastic force of the first elastic member 415. Herein, a spring such as a compression spring may be used for the first elastic member 415, although exemplary embodiments are not limited thereto.

Further, regarding the first elastic member 415, the upper portion 412*b* may be formed to be higher than the height that the pool of condensate can reach so as not to be exposed to the condensate introduced into the opening 413*a* formed on the cover 413. Therefore the first elastic member 415 is not affected by rust, as it is not exposed to the condensate, and the durability and the reliability of the product can be enhanced.

The following will explain the draining process of the air conditioning equipment 1 according to a second embodiment, the constitution of which is already described above. In the following description, similar or identical processes to those already described above will be mentioned as briefly as possible for the sake of brevity.

Likewise in the above-described embodiments, a user may engage the water storage 200 with the housing 100, and drive the air conditioning equipment 1. Herein, the first elastic member 415 is in the compressed state by being interfered with the guide 212 formed on the water container 210.

Thereafter, when the water storage 200 is disengaged from the housing 100, the lid member 412 may be sequentially slid on the second surface 212*b* and the first surface 212*a* of the guide 212, descended by the elastic force of the first elastic member 415, and seated on the sealing member 411. Thus, the discharge port 111 is closed. Likewise in the above-described embodiments, the lid member 412 may surface-contact with the seating portion 411*a* of the sealing member 411, thus maximizing the sealing effects.

When the water storage 200 is mounted to the housing 100, the lid member 412 may ascend while sequentially sliding on the first surface 212*a* and the second surface 212*b* of the guide 212, and the first elastic member 415 may be compressed. Thus, the discharge port 111 is opened.

Figure 14:
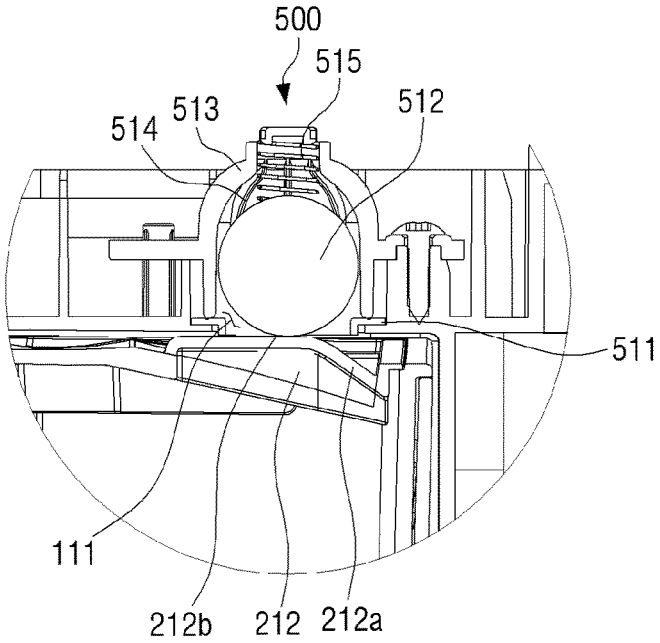
FIG. 14 is an enlarged view of an encircled area II of FIG. 4 according to a third embodiment.
Figure 15:
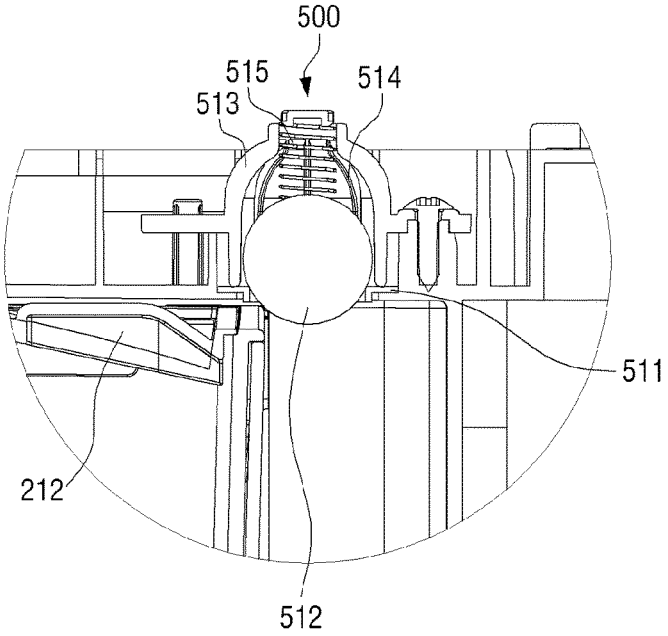
FIG. 15 is an enlarged view illustrating the state in which the water container is separated from the air conditioning equipment illustrated in FIG. 14.

Referring to FIGS. 14 and 15, the air conditioning equipment 1 according to a third embodiment will be described below.

For the sake of brevity, redundant descriptions about the housing 100 and the water storage 200 will be omitted in view of the embodiments already described above, while different constitutions will be mainly described.

The valve 500 according to the third embodiment may include a sealing member 511, a lid member 512, a cover 513, a guide rib 514 and a first elastic member 515.

The lid member 512 according to the third embodiment may have a spherical shape, like the lid member 312 according to the first embodiment. However, the lid member 512 according to the third embodiment may include a first elastic member 515 disposed on an upper surface, which is different from the lid member 312 according to a first embodiment. Thus, the valve 500 according to the third embodiment may block the discharge port 111 by using the weight of the lid member 512 and the elastic force of the first elastic member 515. Accordingly, the effect of sealing the discharge port 111 is increased, compared to the first and the second embodiments.

Further, likewise in the first elastic member 415 according to the second embodiment, the first elastic member 515 according to the third embodiment may be fixed on the upper surface of the cover 513. Further, because the first elastic member 515 may be arranged within the cover 513 so as not to be exposed to the condensate, there is no possibility for the influence of rust and the durability and the reliability of the product can be enhanced.

The following will explain the draining process of the air conditioning equipment 1 according to the third embodiment with the constitution as already described above. In the following description, similar or identical processes to those already described above will be mentioned as briefly as possible for the sake of brevity.

Likewise in the above-described embodiments, a user may engage the water storage 200 with the housing 100, and drive the air conditioning equipment 1. Herein, the first elastic member 515 is in the compressed state by being interfered with the guide 212 formed on the water container 210.

When the water storage 200 is disengaged from the housing 100, the lid member 512 is sequentially slid on the second surface 212*b* and the first surface 212*a* of the guide 212, and descended by the weight of the lid member 512 and the elastic force of the first elastic member 515.

When the water storage 200 is completely disengaged from the housing 100, the lid member 512 is seated on the sealing member 511, thus blocking the discharge port 111. Further, likewise in the above-described embodiments, the lid member 512 may preferably make surface-contact with the seating portion 511*a* of the sealing member 511.

When the water storage 200 is engaged with the housing 100 again, the lid member 512 may ascend by sequentially sliding on the first surface 212*a* and the second surface 212*b* of the guide 212. When the engaging the water storage 200 completes, the discharge port 111 is opened while the first elastic member 515 is in the compressed state.

Figure 16:
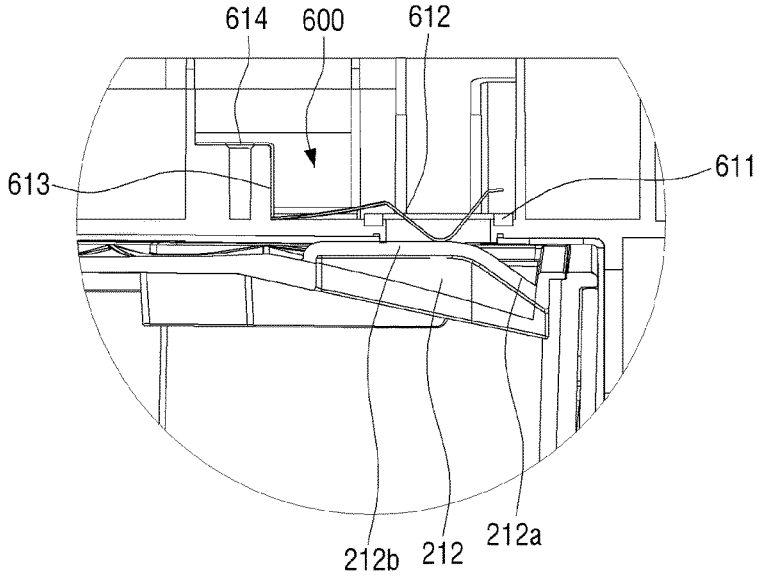
FIG. 16 is an enlarged view of an encircled area II of FIG. 4 according to a fourth embodiment.
Figure 17:
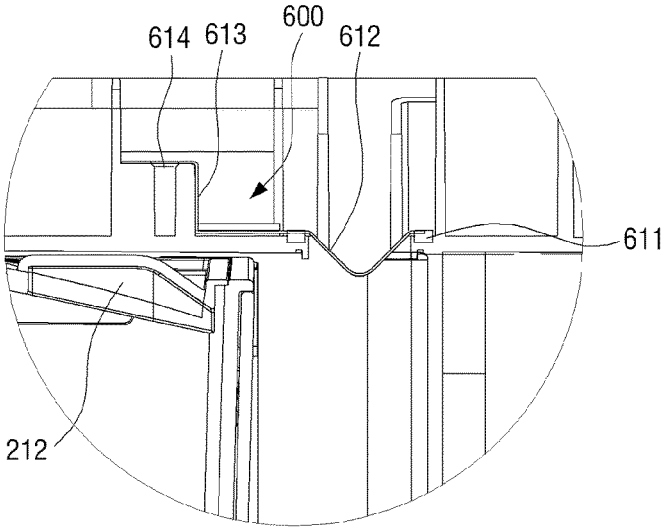
FIG. 17 is an enlarged view illustrating the state in which the water container is separated from the air conditioning equipment illustrated in FIG. 16.

Referring to FIGS. 16 and 17, the air conditioning equipment 1 according to a fourth embodiment will be described below.

For the sake of brevity, redundant descriptions about the housing 100 and the water storage 200 will be omitted in view of the first embodiment already described above, while different constitutions will be mainly described.

The valve 600 according to the fourth embodiment may include a sealing member 611, a lid member 612, an extension 613 and a fixing member 614.

The lid member 612 may have an inverted cone shape which is hollow, e.g., an inverted hollow cone. Thus, the exterior surface may surface-contact with the seating portion 611*a* of the sealing member 611 because of such shape.

The extension 613 may extend toward the fixing member 614 from the lid member 612. The extension 613 may be formed of a material providing an elastic force, and may exert the force so that the lid member 612 directs toward the direction in which the discharge port 111 is closed. Thus, the extension 613 may be spread when covering the discharge port 111. However, when the discharge port 111 is opened, the extension 613 may be bent with its lower portion being convex toward the bottom. In an alternative embodiment, the extension 613 may be fixed to the fixing member 614.

The fixing member 614 may fix the extension 613 to the lower casing 110. Thus, even when the lid member 612 and the extension 613 are interfered with by the guide 212 formed on the water container and lifted, the fixing member 614 is not moved.

The valve 600 according to an embodiment may additionally include a pressing portion arranged on the bent portion of the extension 613 so that the lid member 612 increases the force exerted on the direction in which the discharge port 111 is closed.

Further, the elastic force exerted on the lower side can be further added by arranging the elastic member on the upper portion of the lid member 612. Herein, in order to prevent the elastic member from being exposed to the condensate and influenced by rust, a protecting portion extending upwardly from a center of the lid member 612 may be preferably included.

The following will explain the draining process of the air conditioning equipment 1 according to the fourth embodiment with the constitution as already described above. In the following description, similar or identical processes to those already described above will be mentioned as briefly as possible for the sake of brevity.

Likewise in the above-described embodiments, a user may engage the water storage 200 with the housing 100, and drive the air conditioning equipment 1. Herein, the lid member 612 may be lifted by due to interference by the guide 212 formed on the water container 210, and the discharge port 111 is opened. Thus, the extension 613 is bent in the convex shape toward the bottom.

Thereafter, when the water storage 200 is disengaged from the housing 100, the lid member 612 is descended while sequentially sliding on the second surface 212*b* and the first surface 212*a* of the guide 212 by the elastic force of the extension 613. Thus, the bent extension 613 is straightened back.

Accordingly, the lid member 612 blocks the discharge port 111. Further, likewise in the above-described embodiments, the lid member 612 may preferably surface-contact the seating portion 611*a* of the sealing member 611.

When the water storage 200 is reengaged with the housing 100, the lid member 612 may ascend while sequentially sliding on the first surface 212*a* and the second surface 212*b* of the guide 212, thus opening the discharge port 111.

Figure 18:
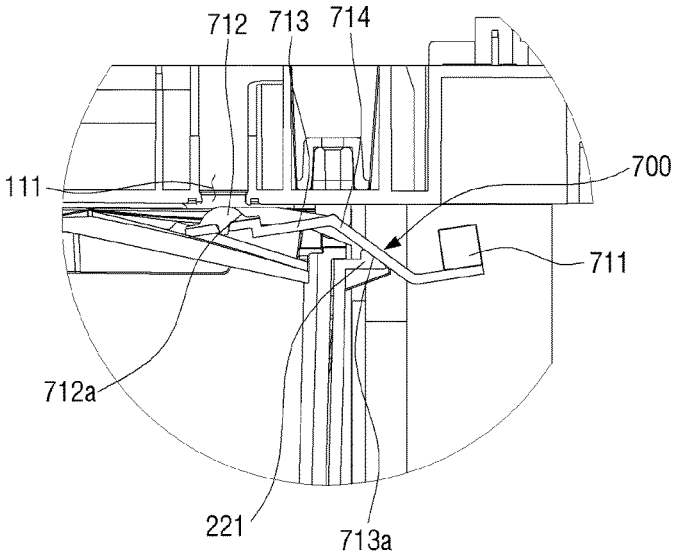
FIG. 18 is an enlarged view of an encircled area II of FIG. 4 according to a fifth embodiment.
Figure 19:
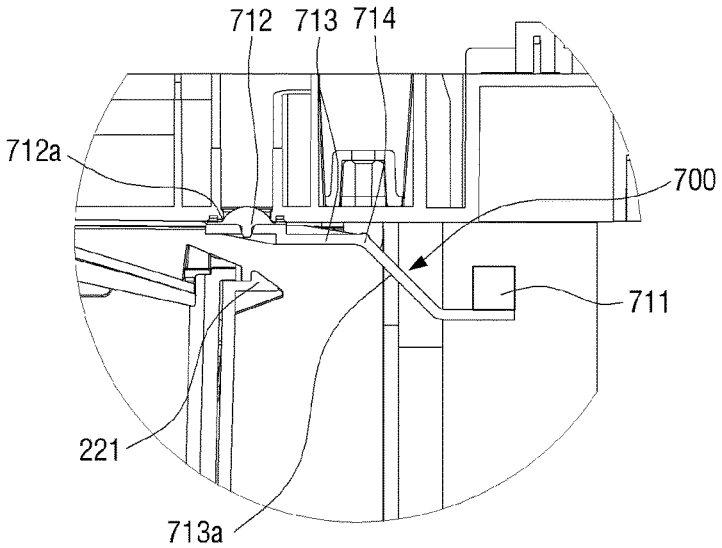
FIG. 19 is an enlarged view illustrating the state in which the water container is separated from the air conditioning equipment illustrated in FIG. 18.
Figure 20:
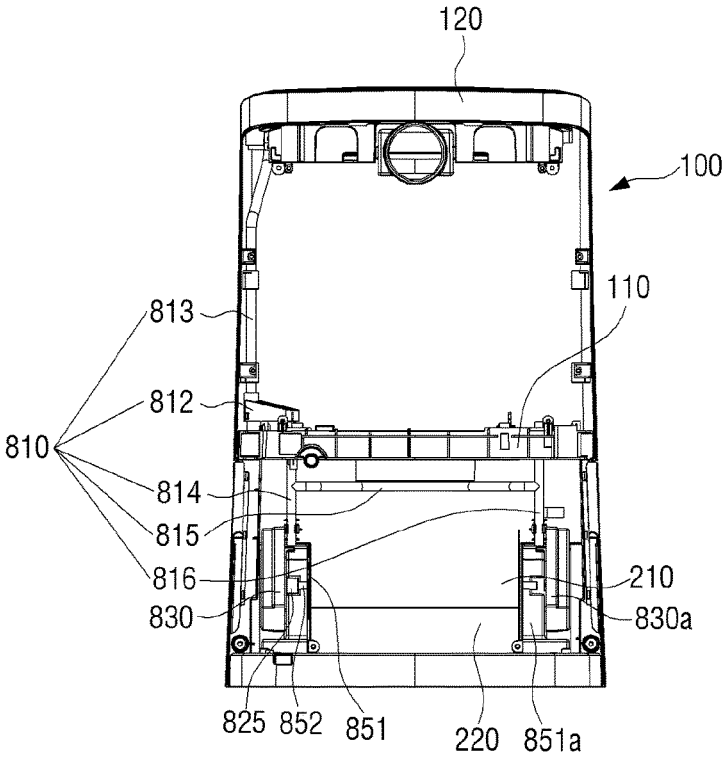
FIG. 20 is a rear view of the air conditioning equipment of FIG. 1 from which a rear cover is separated.
Figure 21:
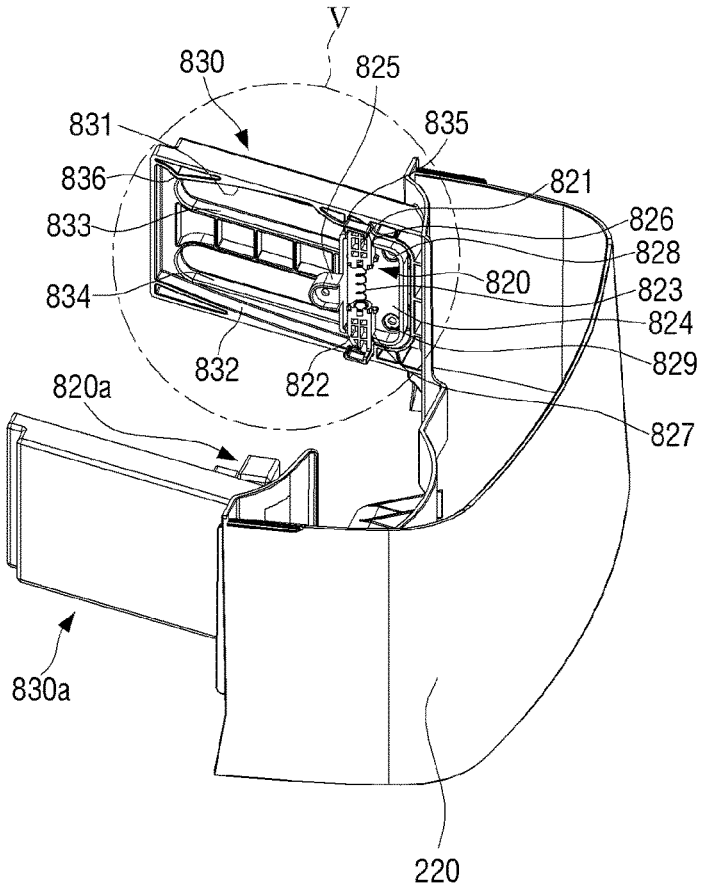
FIG. 21 is a perspective view of a casing of FIG. 1.

Referring to FIGS. 18 and 19, the air conditioning equipment 1 according to a fifth embodiment will be described below.

For the sake of brevity, redundant descriptions about the housing 100 and the water storage 200 will be omitted in view of the first embodiment already described above, while different constitutions will be mainly described.

The valve 700 according to the fifth embodiment may include a load member 711, a lid member 712, a panel 713, and a hinge 714.

The load member 711 may be arranged on one end of the panel 713, and may exert a force with the weight thereof so that the panel 713 rotates in the direction in which the lid member 712 rotates to close the discharge port 111. Herein, the rotating may be performed based on the hinge 714.

The lid member 712 may be arranged on the other end of the panel 713, and may have the convex shape toward the top to block the discharge port 111 from an external area of the housing 100. Further, in an embodiment, the lid member 712 may preferably be formed of a rubber material so that the sealing of the discharge port 111 is effectively performed. However, the exemplary embodiments may not be limited to the above. Further, the lid member 712 may preferably include a seating portion 712*a* on a portion at which the lid member 712 contacts the discharge port 111 to allow surface-contact.

The panel 713 extends rotationally in two directions including the mounting direction and the dismounting direction of the water storage 200 based on the hinge 714, and may include an interference surface 713*a* which is interfered by a protrusion 221 formed on the water container 210.

The hinge 714 is hingedly-engaged with the lower casing 111.

The following will explain the draining process of the air conditioning equipment 1 according to the fifth embodiment. In the following description, similar or identical processes to those already described above will be mentioned as briefly as possible for the sake of brevity.

Likewise in the above-described embodiments, a user may engage the water storage 200 with the housing 100, and drive the air conditioning equipment 1. Herein, because the protrusion 221 of the water container 210 may push the interference surface 713*a* of the panel 713, the load member 711 may be lifted in a direction opposite of gravity. Accordingly, the panel 713 may rotate counter-clockwise based on the hinge 714, and the lid member 712 may open the discharge port 111.

When the water storage 200 is disengaged from the housing 100, the force with which the protrusion 221 of the water container 210 pushes the interference surface 713*a* of the panel 713 may be removed. Thus, the panel 713 may rotate clockwise with the weight of the load member 711. Therefore, the lid member 712 may move to the position of closing the discharge port 111.

When the water storage 200 is mounted to the housing 100, the protrusion 221 of the water container 210 may push the interference surface 713*a* of the panel 713, and the panel 713 may rotate counter-clockwise. Accordingly, the lid member 712 may open the discharge port 111.

Referring to FIGS. 1 and 20, 21, 22, and 23, the following will explain the constitution in which the water storage 200 of the air conditioning equipment 1 according to the first embodiment may be disengaged.

The air conditioning equipment 1 according to the first embodiment may include an external force transmitter 810, a sliding portion 820, a fixer 851, and a guide panel 830 in order to disengage the water storage 200 from the housing 100.

The external force transmitter 810 may be arranged within the housing 100, and may include a first and a second buttons 811, 812, and a first to a fourth shafts 813-816.

The first button 811 may be formed to protrude from the upper surface of the housing 100. Because one end of the first button 811 may be a portion which is pressed by a user to disengage the water storage 200, the edge may be preferably fillet-formed. Further, a spring (not illustrated) may be provided within the first button 811, in which case the first button 811 may be automatically sprung to the original position or non-depressed position without requiring a user to perform any other operation except pushing the first button 811. The external force exerted to the first button 811 may be transmitted to the first shaft 813.

One end of the first shaft 813 may be connected to the other end of the first button 811, and may receive the external force from the first button 811. Further, the first shaft 813 may be preferably arranged on the edge area of the upper casing 120 so as not to interfere with the portions within the housing 100. The first shaft 813 extends from an upper end of the upper casing 120 to a lower end thereof, and may transmit the external force to the second button 812 connected at the other end.

One end of the second button 812 may be connected with the other end of the first shaft 813, and may receive the external force from the first shaft 813. Because the axis in which the first shaft 813 transmits the force is spaced from the axis in which the sliding portion 820 should receive the force, the second button 812 may shift the axis where the force is acted, i.e., from the axis where the force is transmitted from the first shaft 813 to the axis where the force needs to be received by the sliding portion 820. The second button 812 may transmit the external force to the second shaft 814 connected at the other end.

One end of the second shaft 814 may be connected with the other end of the second button 812, and may receive the external force from the second button 812. The other end of the second shaft 814 may contact the sliding portion 820 and may transmit the external force to the sliding portion 820.

The third shaft 815 extends perpendicularly on the exterior surface of the second shaft 814 from the second shaft 814 to the fourth shafts 816. The third shaft 815 may be formed to be symmetrical with the sliding portion 820 contacting the second shaft 814, and may transmit the external force to the fourth shafts 816 exerting an external force to the additional sliding portion 820*a* arranged on the contrary side.

The fourth shaft 816 may be parallel with the second shaft 814, and arranged perpendicularly to the third shaft 815. Accordingly, the fourth shaft 816 may receive the external force from the third shaft 815, and transmit the external force to the additional sliding portion 820*a*. Herein, because the second to the fourth shafts 814-816 are connected to each other, the third shaft 815 and the fourth shaft 816 may both descend according to the descending of the second shaft 814.

The sliding portion 820 may receive the external force from the external force transmitter 810, and slide-drive along the guide panel 830. The sliding portion 820 may include a first slider 821, a second slider 822, a second elastic member 823, and a fixing casing 824.

The first slider 821 may include a first sliding surface 821*a* formed on one end and a pushing portion 821*b*. Further, the other end of the first slider 821 may be connected with one end of the second elastic member 823, and may always receive the force in the direction toward the first guide surface 831.

The first sliding surface 821*a* may slide along the first guide surface 831 formed on the guide panel 830. Thus, the surface of the first sliding surface 821*a* may be preferably formed to be smooth in order to reduce the friction with the first guide surface 831.

The pushing portion 821*b* may be formed to protrude at one end of the first slider 821 in order to receive the external force from the external force transmitter 810. Accordingly, when the pushing portion 821*b* is pressed by the second shaft 814, the first slider 821 may descend, and the interference of the first sliding surface 821*a* may be released from a first locking portion 835 while the first slider 821 descends.

One end of the second slider 822 may be connected with the other end of the second elastic member 823, and may always receive the force on the direction toward a second guide surface 832. Further, formed on the other end may be the second sliding surface 822*a* on which the second guide surface 832 formed on the guide panel 830 is slid. The surface of the second sliding surface 822*a* may be also formed to be smooth in order to reduce the friction with the second guide surface 832.

The second elastic member 823 may be arranged between the first slider 821 and the second slider 822, and may exert a force so that the first slider 821 and the second slider 822 are spaced apart from each other. Accordingly, the first sliding surface 821*a* and the second sliding surface 822*a* may respectively receive a force toward the first guide surface 831 and the second guide surface 832. The force applied by the second elastic member 823 on the first sliding surface 821*a* and the second sliding surface 822*a* may increase the friction force with the first guide surface 831 and the second guide surface 832. The friction force may prevent the strong shock between the sliding portion 820 and the guide panel 830 which may occur by rapid disengaging of the water storage 200 from the housing 100 and also a gradually decreasing gap between the first guide surface 831 and the second guide surface 832, which will be described below. Thus, the water stored in the water container 210 may be prevented from being slopped or overflowing due to rapid disengaging of the water storage 200 from the housing 100.

Further, the second elastic member 823 according to an embodiment may as an example be a spring, although exemplary embodiments are not limited thereto.

The fixing casing 824 may be fixed within a fixing portion 851 which will be described below, and may include the second elastic member 823. The fixing casing 824 may include a connecting portion 825, a first guide groove 826, a second guide groove 827, a first hole 828, and a second hole 829.

The connecting portion 825 may be connected with a fixing rib 852 formed on the fixing portion 851 so that the fixing casing 824 is not moved when performing the disengaging of the water storage 200 from the housing 100.

The first guide groove 826 and the second guide groove 827 may be respectively formed on the portions of the upper end and the lower end of the fixing casing 824 at which the first slider 821 and the second slider 822 are arranged. The first slider 821 and the second slider 822 may be respectively inserted into the first guide groove 826 and the second guide groove 827 so that the first slider 821 and the second slider 822 perform the sliding. Accordingly, the first slider 821 and the second slider 822 may respectively perform the perpendicular movement only by the first guide groove 826 and the second guide groove 827.

The first hole 828 and the second hole 829 may be respectively engaged with a first and a second rolling members 841, 842 which rotate along the third guide surface 833 and the fourth guide surface 834 formed on the guide panel 830. The first and the second rolling members 841, 842 may enhance the reliability of the slide-driving between the sliding portion 820 and the guide panel 830.

The fixing portion 851 extends on a rear portion of the lower casing 110, and may include the fixing rib 852 and an interference portion 853.

The fixing rib 852 may fix the fixing casing 824 by being connected with the connecting portion 825 so as not to be moved when the water storage 200 is disengaged.

The interference portion 853 may be provided on the upper portion of the fixing portion 851, and may guide the first slider 821 with the first guide groove 826 so that the first slider 821 does not move toward the side out of the vertical path.

The guide panel 830 extends in the upper directional slope toward the mounting direction of the water storage 200 on the both sides of the rear portion of the casing 220. The guide panel 830 may include the first to the fourth guide surface 831-834, the first locking portion 835 and the second locking portion 836.

The first guide surface 831 may contact the surface with the first sliding surface 821*a*, and may be path in which the first slider 821 performs the sliding during the disengaging of the water storage 200.

The second guide surface 832 may contact the surface with the second sliding surface 822*a*, and may be path in which the second slider 822 performs the sliding during the disengaging of the water storage 200.

The first guide surface 831 and the second guide surface 832 may be formed so that the gap between the surfaces becomes narrower while going toward the mounting direction of the water storage 200. Such shape may prevent the strong shock between the sliding portion 820 and the guide panel 830 which may occur by rapidly disengaging the water storage 200 from the housing 100 with the friction force between the first guide surface 831 and the second guide surface 832 according to the force exerted by the second elastic member 823 on the first slider 821 and the second slider 822, as mentioned above. Accordingly, the water stored in the water container 210 can be prevented from being overflowed.

The third guide surface 833 may contact the surface with the first rolling member 841, and may be path in which the first rolling member 841 rotates during the disjoining of the water storage 200.

The fourth guide surface 834 may contact the surface with the second rolling member 842, and may be path in which the second rolling member 842 rotates during the disengaging of the water storage 200.

The third and the fourth guide surface 833, 834 may enhance the reliability of the slide-driving between the sliding portion 820 and the guide panel 830.

The first locking portion 835 may be formed to protrude at one end of the first guide surface 831, and may interfere in the first slider 821 so that the water storage 200 keeps in the engaged state.

The second locking portion 836 may be formed to protrude at the other end of the first guide surface 831, and may interfere in the first slider 821 so that the water storage 200 keeps in the engaged state. However, the second locking portion 836 may be formed to protrude in a smaller amount preferably so that the guide panel 830 easily moves toward the mounting direction by the external force of a user.

The above described sliding portion 820, the fixing portion 851 and the guide panel 830 may be respectively provided to be one pair on the both sides according to an embodiment in view of the force distribution and the manufacturing cost. However, only one item may be provided on the center, and three or more items may be provided by adjusting the balance of the force.

Further, the additional sliding portion 820*a*, the additional fixing portion 851*a* and the additional guide panel 830*a*, which may be one pair with the sliding portion 820, the fixing portion 851 and the guide panel 830 and arranged on the contrary side, may be formed to be symmetrical with the sliding portion 820, the fixing portion 851, and the guide panel 830, which may be explained above. Thus, the further descriptions may not be provided below.

The following will describe the disengaging the water storage 200 of the air conditioning equipment 1 according to a first embodiment which is constituted described above by referring to FIGS. 1 and 22 to 28.

Figure 22:
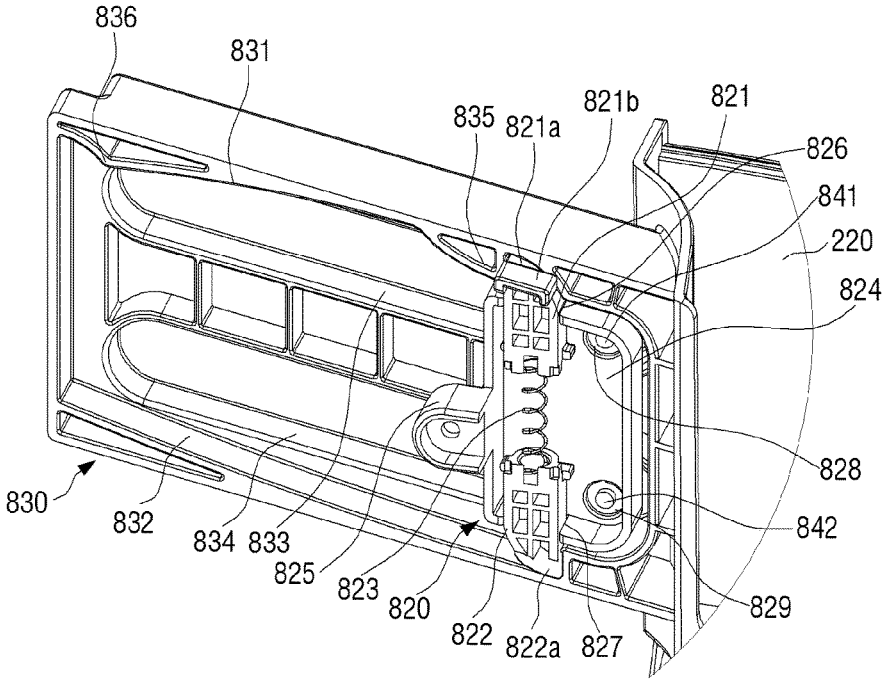
FIG. 22 is an enlarged view of an encircled area V of FIG. 21.
Figure 24:
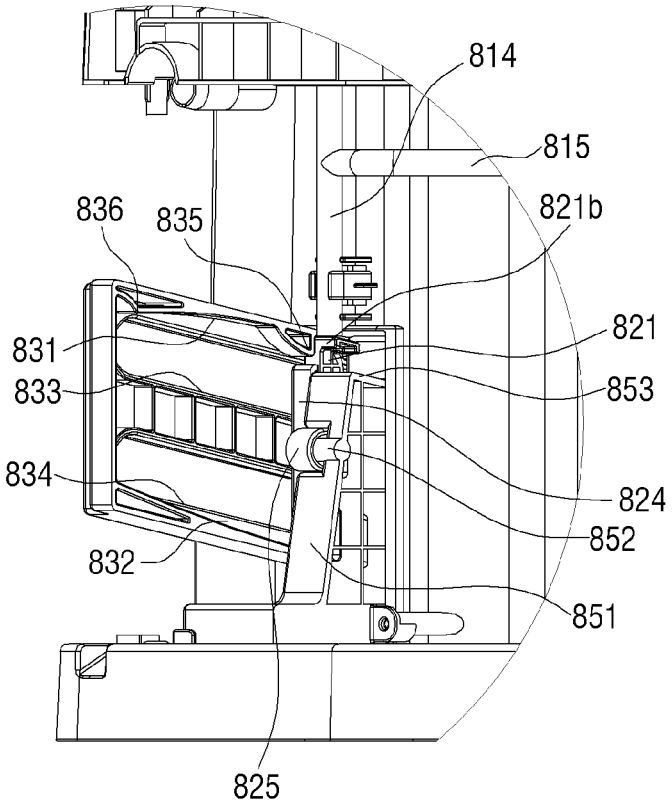
FIGS. 24, 25, 26, 27, and 28 are enlarged views illustrating changes occurring in the encircled area VI of FIG. 23.
Figure 25:
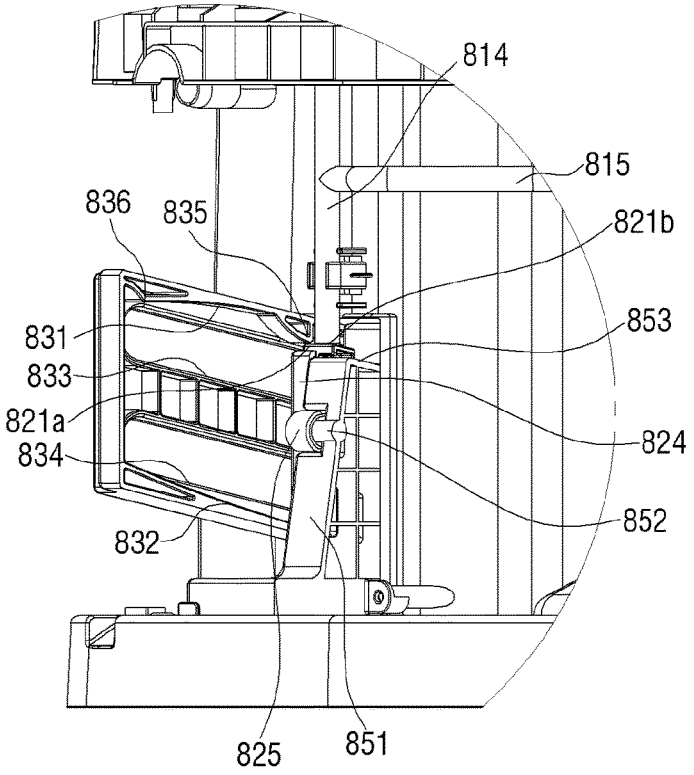
Figure 26:
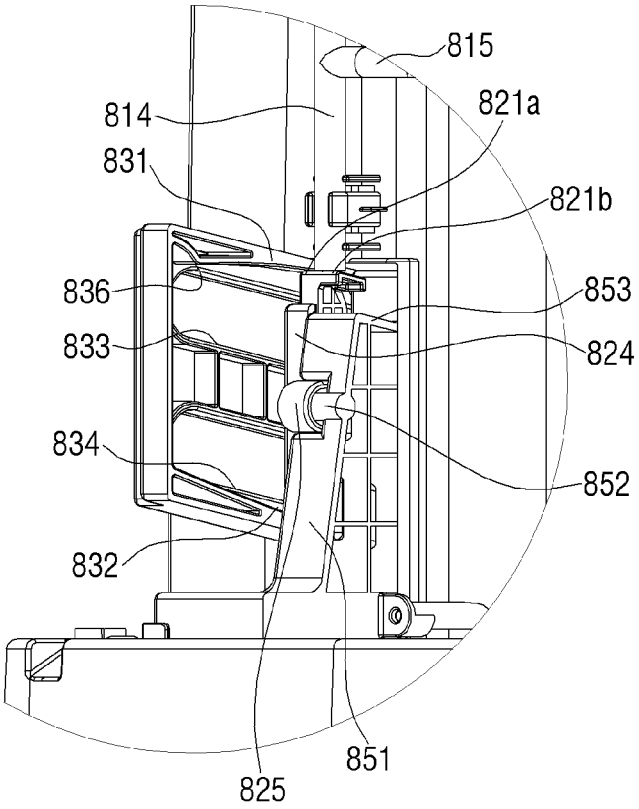

Referring to FIGS. 1, 22 and 24, the water storage 200 of the air conditioning equipment 1 according to the first embodiment may be mounted to the housing 100. Herein, the second shaft 814 may not press the pushing portion 821*b*, and the first slider 821 may be interfered by the first locking portion 835.

Referring to FIGS. 1, 22, 23 and 25, a user may exert the external force to the first button 811, and the external force may be transmitted to the second shaft 814 through the first shaft 813 and the second button 812. Thus, the second shaft 814 may press the pushing portion 821*b*, and the first slider 821 may move downward by the guidance of the fixing casing 824. Further, the interference of the first sliding surface 821*a* by the first locking portion 835 may be released while the first slider 821 moves downward. In this case, the second elastic member 823 may be compressed.

Further, the external force transmitted to the second shaft 814 may be transmitted to the fourth shaft 816 by the third shaft 815 connected with the second shaft 814, and the above described process in the sliding portion 820 may be performed in the additional sliding portion 820*a*. Because the additional sliding portion 820*a* arranged on the opposite side is driven in the same manner as the sliding portion 820, redundant description will be omitted for the sake of brevity.

Referring to FIGS. 1, 22, 23 and 26, a user may discontinue exerting the external force from the first button 811. Accordingly, the first and the second buttons 811, 813 and the first to the fourth shafts 813-816 may go back to the original positions by the spring provided on the first button 811.

Further, because the guide panel 830 is slanted, the water storage 200 may advance and descend with the weight and may be disengaged from the housing 100 when the locking on the first sliding surface 821*a* by the first locking portion 835 is released. Thus, a user does not have to perform another operation except for pushing the first button 811 in order to disengage the water storage 200 from the housing 100.

As disengaging the water storage 200 begins, the first slider 821 is guided downward by the first guide groove 826 and the interference portion 853, and the second slider 822 may be guided upward by the second guide groove 827.

Further, the first sliding surface 821*a* may slide along the first guide surface 831 in the direction in which the water storage 200 is disengaged, and the second sliding surface 822*a* may slide along the second guide surface 832 in the direction in which the water storage 200 is disengaged. Further, the first rolling member 841 may rotate along the third guide surface 833 in the direction in which the water storage 200 is disengaged, and the second rolling member 842 may rotate along the fourth guide surface 834 in the direction in which the water storage 200 is disengaged.

Meanwhile, because the fixing casing 824 may be fixed on the fixing portion 851, the fixing casing 824 may not be moved, and may only guide the perpendicular movement of the first slider 821 and the second slider 822.

Figure 23:
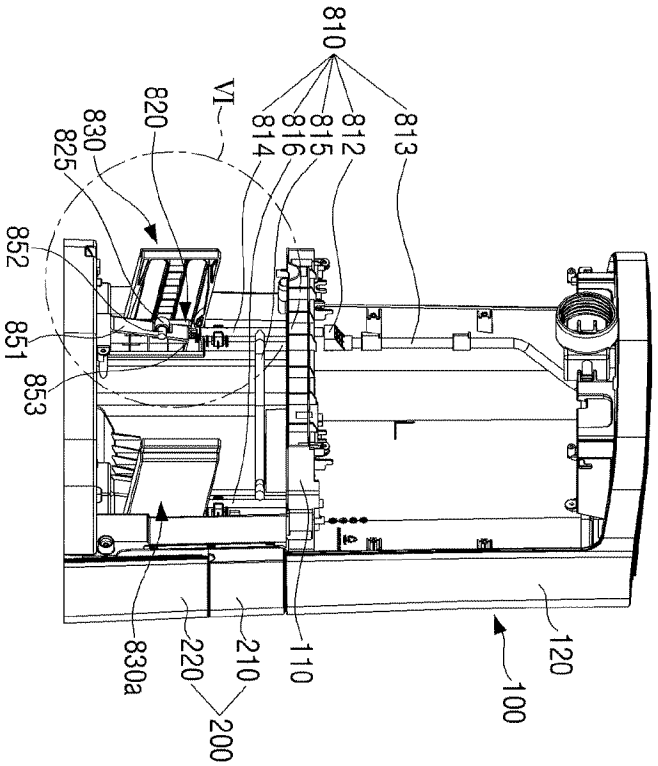
FIG. 23 is a side view of the air conditioning equipment of FIG. 20 viewed from the side.
Figure 27:
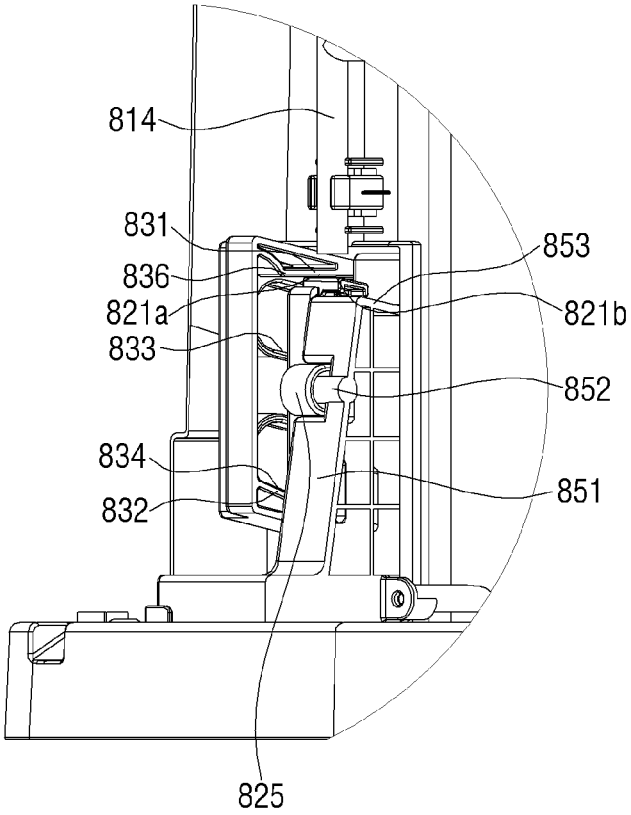

Referring to FIGS. 22, 23 and 27, as the disengaging operation continues with the first sliding surface 821*a* and the second sliding surface 822*a* sliding on the first guide surface 831 and the second guide surface 832, the gap between the first guide surface 831 and the second guide surface 832 may decrease. Further, because the second elastic member 823 is compressed during the above process, the force pushing the first slider 821 and the second slider 822 toward the first guide surface 831 and the second guide surface 832 may increase. Accordingly, the friction force between the first slider 821 and the first guide surface 831 and the friction force between the second slider 822 and the second guide surface 832 may both increase. Thus, the speed in disengaging the water storage 200 may decrease. Because the speed in disengaging the water storage 200 decreases, the water storage 200 may not be rapidly disengaged and the shock which may occur at the moment when the sliding portion 820 contacts the guide panel 830 may decrease. Accordingly, the condensate stored in the water container 210 may be prevented from being overflowed externally when performing the disengaging the water storing basket 200.

Figure 28:
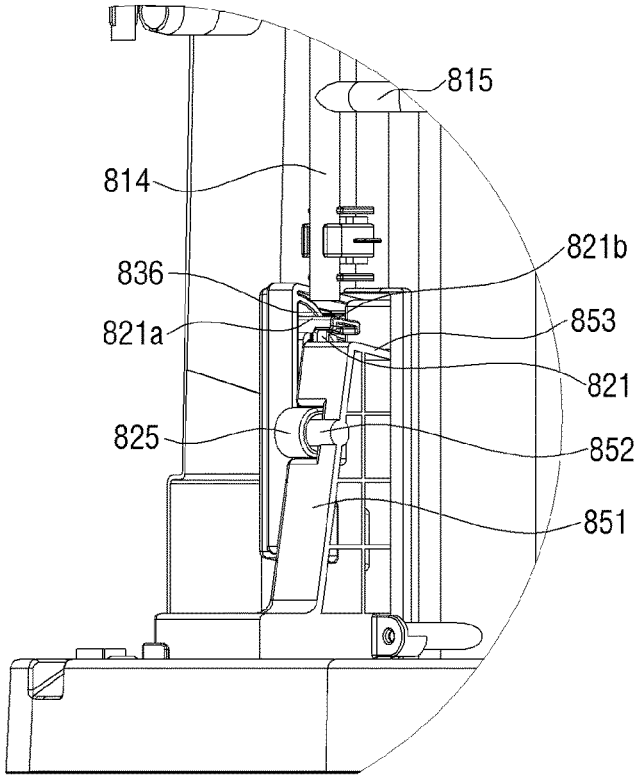

Referring to FIGS. 22, 23 and 28, the water storage 200 may arrive at a final position to disengage the water container 210 from the casing 220, and the first sliding surface 821*a* may be locked on the second locking portion 836. Thus, the water storage 200 may keep in the disengaged state. Because the protruding of the second locking portion 836 is not large as described above, a user may engage the water storage 200 with the housing 100 again by exerting the light external force on the water storage 200 in the direction in which the water storage 200 is engaged.

Figure 29:
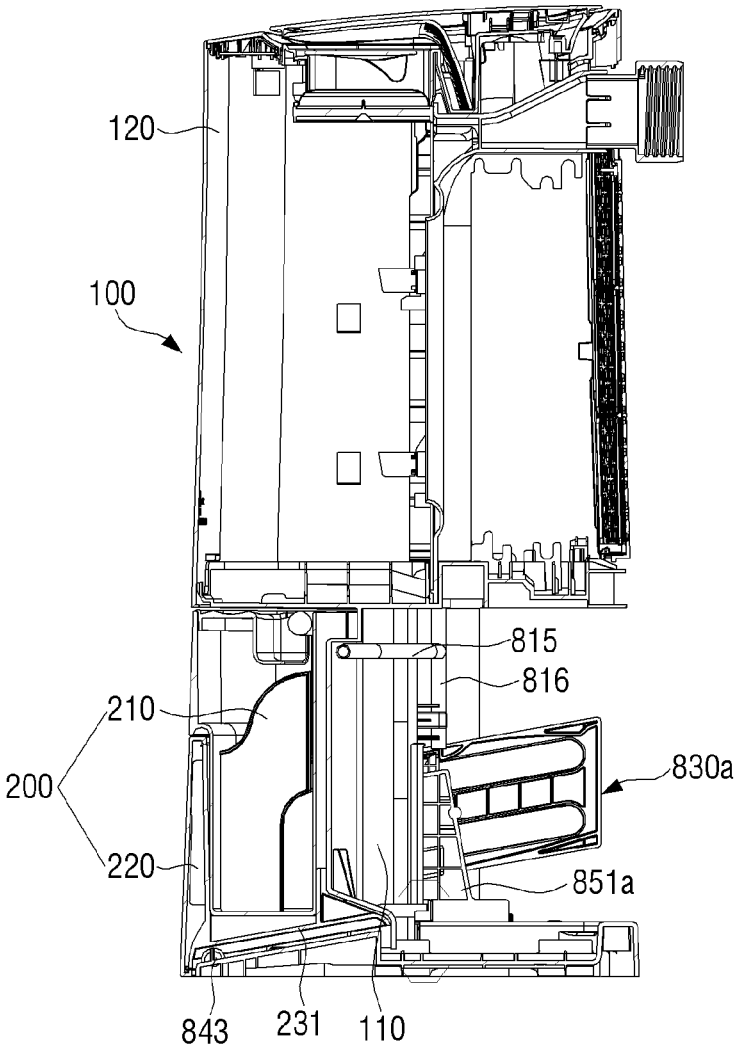
FIG. 29 is a cross sectional view taken on line A-A of FIG. 1.
Figure 30:
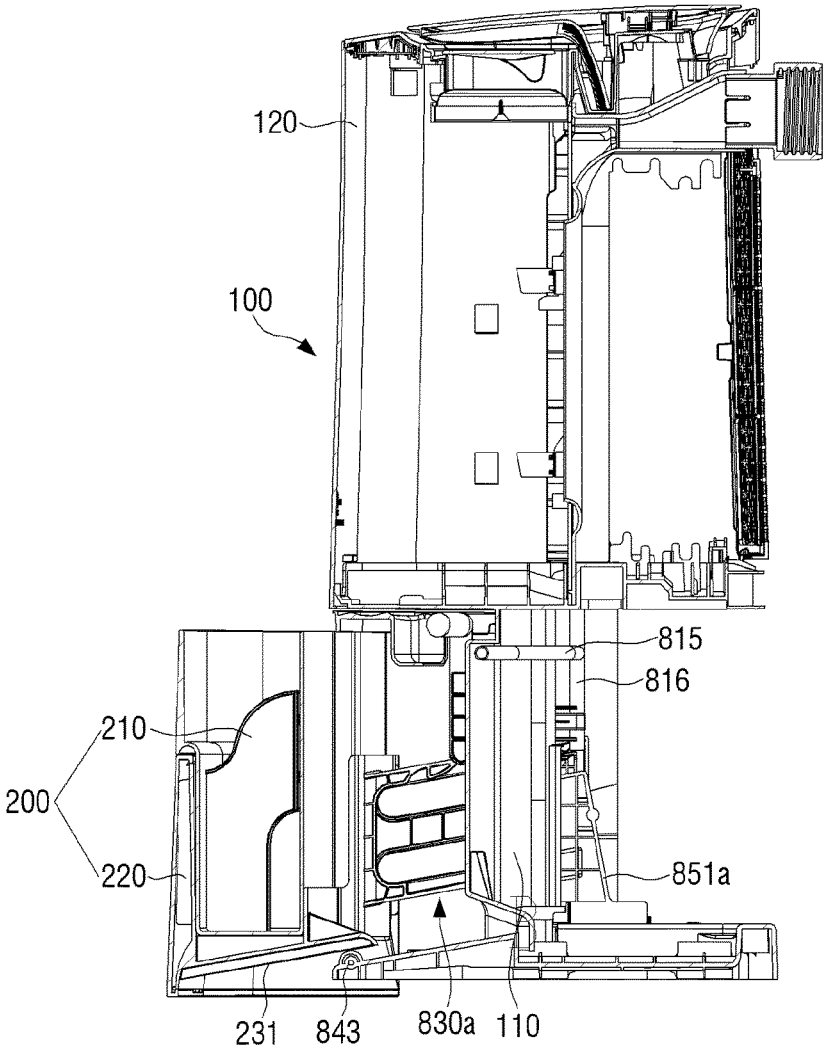
FIG. 30 is a sectioned view illustrating the state in which a water storage is separated from the air conditioning equipment illustrated in FIG. 29.

Further, referring to FIGS. 29 and 30, the air conditioning equipment 1 according to a first embodiment may include a third rolling member 843 provided on the lower side of the lower casing 110 so that the water storage 200 advances and descends while minimizing the influence of the friction between the casing 220 and the lower side of the lower casing 110 when the water storage 200 is disengaged from the housing 100. The third rolling member 843 may rotate in contact with the bottom surface 231 of the water storage 200. Thus, the water storage 200 may be driven smoothly by reducing the influence of the friction.

Figure 31:
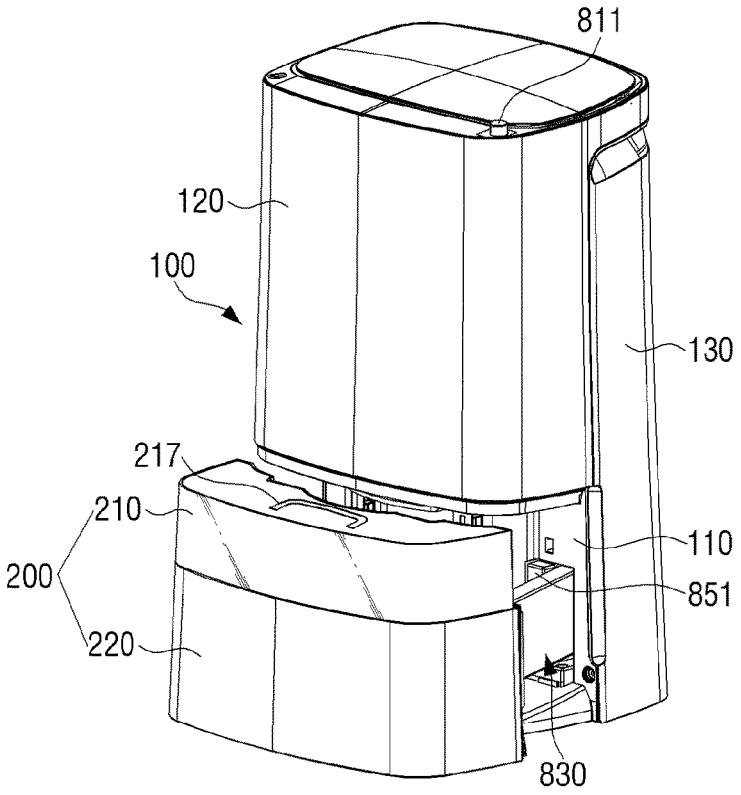
FIG. 31 is a perspective view of the air conditioning equipment of FIG. 1 from which a water storage is separated.

FIG. 31 illustrates the water storage 200 disengaged from the housing 100 according to the above described processes.

A user may disengage the water storage 200 from the housing 100 by pushing the first button 811 only once.

Figure 32:
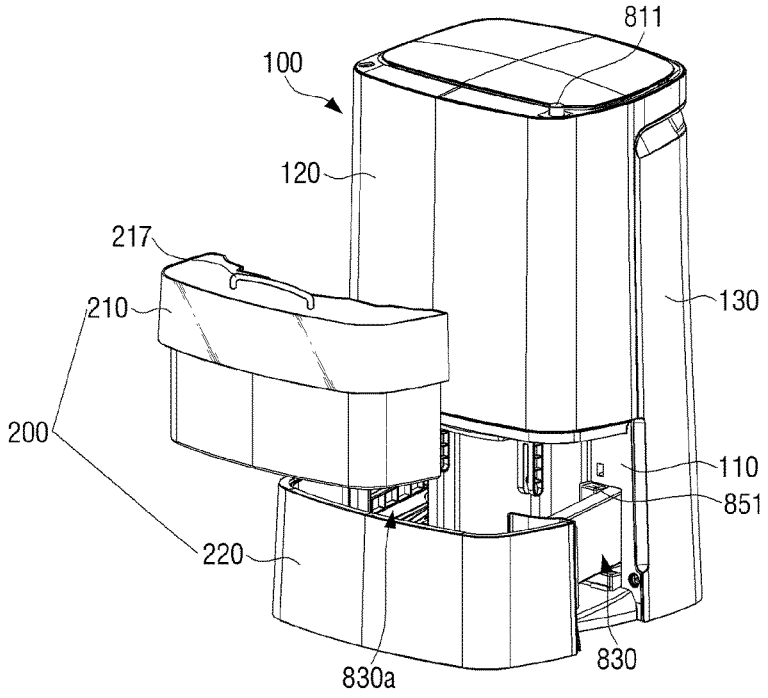
FIG. 32 is a perspective view of the water storage of FIG. 31 from which the water container is separated.

Thereafter, a user may separate, by lifting, the water container 210 from the casing 220 in order to empty the condensate stored in the water container 210, as illustrated in FIG. 32. For the user convenience, the upper portion of the water container 210 may include a handgrip 217.

The foregoing exemplary embodiments and advantages are merely exemplary and are not to be construed as limiting the exemplary embodiments. The present teaching can be readily applied to other types of apparatuses. Also, the description of the exemplary embodiments of the present inventive concept is intended to be illustrative, and not to limit the scope of the claims.

What is claimed is:

1. An air conditioning equipment, comprising:

a housing comprising a heat exchanger therein and a discharge port to discharge condensate from the housing;

a water container configured to selectively mount to, and dismount from, a receiving portion of the housing and to collect the condensate generated by the heat exchanger; and a valve configured to selectively open and close the discharge port by being interfered with by a portion of the water container according to the mounting and the dismounting of the water container to or from the receiving portion of the housing, wherein the valve comprises:

a sealing member arranged along an edge of the discharge port, a lid member configured to be selectively seated on the sealing member, a cover covering the lid member, and an elastic member arranged between the lid member and the cover, the elastic member pressing the lid member toward a gravity direction, wherein the cover is provided with an opening formed on a portion of the cover at which the cover meets a discharge path guiding the condensate to the discharge port, and wherein when the portion of the water container is mounted to the receiving portion of the housing, the lid member ascends and the elastic member is compressed by the portion of the water container.

2. The air conditioning equipment of claim 1, wherein the lid member is formed in a spherical shape.

3. The air conditioning equipment of claim 1, wherein the sealing member is provided with a seating portion corresponding to a shape of an exterior surface of the lid member in order to surface-contact the lid member.

4. The air conditioning equipment of claim 1, wherein the sealing member is formed of a rubber material.

5. The air conditioning equipment of claim 1, wherein the cover is engaged to the housing using at least one of a hook and a screw.

6. The air conditioning equipment of claim 1, wherein the cover comprises a guide rib disposed therein to guide a perpendicular movement of the lid member within an internal area of the cover.

7. The air conditioning equipment of claim 1, wherein the water container comprises:

an inlet to which the condensate discharged from the discharge port is introduced; and a guide configured to interfere with the valve during the mounting of the water container to the housing.

8. The air conditioning equipment of claim 7, wherein the water container further comprises an absorbing member attached to an avoiding groove to absorb the condensate remaining on a lower portion of the valve, to a portion of an upper surface of the water container on which the guide is formed.

9. The air conditioning equipment of claim 8, wherein the absorbing member attached to the avoiding groove is set in a position in which the absorbing member is aligned with the valve along a direction in which the water container is disengaged.

10. The air conditioning equipment of claim 1, wherein the housing comprises:

an auxiliary discharge port configured to discharge the condensate exceeding a preset level when the water container is dismounted from the receiving portion of the housing; and a water storage recess on a bottom surface of the housing corresponding to the auxiliary discharge port.

11. The air conditioning equipment of claim 1, comprising:

a casing to which the water container is mounted;

a guide panel formed on the casing to guide the water container along a path in which the casing is mounted to, and dismounted from the housing;

a sliding portion formed on the housing and slidably contacting the guide panel; and an external force transmitter configured to exert an external force to the sliding portion so that the sliding portion starts sliding with respect to the guide panel.

12. The air conditioning equipment of claim 11, wherein the guide panel comprises:

a guide surface sliding with respect to the sliding portion; and a locking portion to limit the sliding of the casing with the sliding portion when mounted to the housing.

13. The air conditioning equipment of claim 12, wherein the guide surface comprises a deceleration section which reduces a sliding speed of the sliding portion.

14. The air conditioning equipment of claim 11, wherein the guide panel is formed on the casing, upwardly slanted.

15. The air conditioning equipment of claim 11, wherein the elastic member is a first elastic member and the sliding portion comprises:

a first slider and a second slider for sliding on the guide panel; and a second elastic member arranged between the first slider and the second slider to exert a force in a direction in which the first slider and the second slider are spaced apart from each other.

16. The air conditioning equipment of claim 11, wherein the external force transmitter comprises:

a button arranged on an upper surface of the housing; and a shaft which transmits the external force exerted on the button to the sliding portion.

17. The air conditioning equipment of claim 1, wherein the valve is inserted within the receiving portion of the housing through the discharge port in order to reduce a protruded length to be interfered with by the portion of the water container.

18. The air conditioning equipment of claim 1, wherein the lid member comprises one of a steel sphere and a semi-spherical shape having an upper portion formed in a cylindrical shape extending upward from the center of the semi-sphere.

19. An air conditioning apparatus, comprising:

a housing comprising a heat exchanger therein;

a water container which collects a condensate generated by the heat exchanger; and a valve inserted within a receiving portion of the housing, and comprising a lid member to selectively open and close a discharge port by being interfered with by the water container when the water container is mounted to, and dismounted from the receiving portion of the housing, wherein the lid member is curved and protruded, while being positioned over the discharge port;

wherein the valve comprises:

a sealing member arranged along an edge of the discharge port, a cover covering the lid member, and an elastic member arranged between the lid member and the cover, the elastic member pressing the lid member toward a gravity direction, wherein the cover is provided with an opening formed on a portion of the cover at which the cover meets a discharge path guiding the condensate to the discharge port, and wherein when the portion of the water container is mounted to the receiving portion of the housing, the lid member ascends and the elastic member is compressed by a portion of the water container.

20. The air conditioning apparatus of claim 19, wherein the lid member is formed in a spherical shape or a semi-spherical shape.

21. A dehumidifier comprising:

a housing forming an exterior of the dehumidifier and including a discharge port to discharge condensate from the housing;

a water storage container engaged with the housing to collect the condensate discharged from the housing, the water storage container including a guide formed on an upper surface of the water storage container; and a valve arranged on a portion of the housing where the discharge port is formed, the valve comprising a lid member formed to correspond to a shape of the discharge port to selectively block the discharge port in accordance with a relative position of the guide with respect to the lid member;

wherein the valve comprises:

a sealing member arranged along an edge of the discharge port, a cover covering the lid member, and an elastic member arranged between the lid member and the cover, the elastic member pressing the lid member toward a gravity direction, wherein the cover is provided with an opening formed on a portion of the cover at which the cover meets a discharge path guiding the condensate to the discharge port, and wherein when the water container is mounted to the housing, the lid member ascends and the elastic member is compressed by the guide of the water container.

22. The dehumidifier of claim 21, wherein the guide comprises:

a first surface comprised of an inclined plane; and a second surface that is substantially flat to support the lid member.

23. The dehumidifier of claim 21, wherein the water container is configured to selectively mount to and dismount from, a receiving portion of the housing, wherein the selectively blocking the discharge port comprises selectively opening or closing the discharge port, and wherein the relative position of the guide with respect to the lid member comprises a first position in which the water container is mounted to the receiving portion of the housing and a second position in which the water container is dismounted from the receiving portion of the housing.

24. The dehumidifier of claim 21, wherein the lid member comprises one of a steel sphere and a semi-spherical shape having an upper portion formed in a cylindrical shape extending upward from the center of the semi-sphere.

* * * * *